US006493012B2

(12) United States Patent
Buch et al.

(10) Patent No.: US 6,493,012 B2
(45) Date of Patent: Dec. 10, 2002

(54) METHOD AND APPARATUS FOR SETTING REGISTER ON A MULTICOLOR PRINTING MACHINE BY TIME INDEPENDENT ALLOCATION OF POSITIONS OF IMAGE PRODUCTIONS TO PRINTING SUBSTRATES

(75) Inventors: Donald Buch, Penfield, NY (US); Ingo Klaus Dreher, Kiel (DE); Heiko Hunold, Wattenbek (DE); Christopher Liston, Rochester, NY (US); Patrick Metzler, Gettorf (DE); Michael Mordhorst, Strohbrück (DE); Stephan Walter Pareigis, Molfsee (DE); Robert Peffer, Penfield, NY (US); Karlheinz Walter Peter, Molfsee (DE); Ralph Petersen, Kiel (DE); Frank Pierel, Kiel (DE); John Robert Thompson, Webster, NY (US); Günther Voss, Barkelsby (DE)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/860,120

(22) Filed: May 17, 2001

(65) Prior Publication Data

US 2002/0001491 A1 Jan. 3, 2002

Related U.S. Application Data

(60) Provisional application No. 60/204,682, filed on May 17, 2000.

(51) Int. Cl.[7] ..... G03G 15/01

(52) U.S. Cl. ..... 347/116; 358/1.18; 399/301

(58) Field of Search ..... 347/116; 399/301, 399/299; 101/182, 211; 358/1.1, 1.18

(56) References Cited

U.S. PATENT DOCUMENTS 5,287,162 A * 2/1994 de Jong et al. ..... 226/29
5,806,430 A * 9/1998 Rodi ..... 101/181
6,278,857 B1 * 8/2001 Monji et al. ..... 318/85

* cited by examiner

*Primary Examiner*—Joan Pendegrass
(74) *Attorney, Agent, or Firm*—Lawrence P. Kessler

(57) ABSTRACT

A method and apparatus for setting register on a multicolor printing machine (1) having color printing units (6, 6', 6", 6''') allocated to various printing inks and having image cylinders (2, 2'), equipment (3, 3') for producing images, in particular electrostatic latent images, on the image cylinders (2, 2', . . .), a carrier (4) for printing substrates (15) and image transfer points (5, 5', 5", 5''') for the transfer of the color separations (7, 7', . . .) from the color printing units (6, 6', 6", 6''') to the printing substrates (15), an allocation of the image productions (11, 11') on the image cylinders (2, 2', . . .) to the printing substrates (15) being carried out in order to achieve coincidence of register of the color separations (7, 7', . . .) in the print. This is achieved by a time-independent allocation of the positions of the image productions (11, 11', . . .) on the image cylinders (2, 2', . . .) to the printing substrates (15) being carried out for at least one defined area (10, 10', 10", . . . , 10$^{n}$) of all the color separations (7, 7', . . .).

96 Claims, 6 Drawing Sheets

METHOD AND APPARATUS FOR SETTING REGISTER ON A MULTICOLOR PRINTING MACHINE BY TIME INDEPENDENT ALLOCATION OF POSITIONS OF IMAGE PRODUCTIONS TO PRINTING SUBSTRATES

CROSS REFERENCE TO RELATED APPLICATION

Reference is made to and priority claimed from U.S. Provisional Application Ser. No. 60/204,682, filed May 17, 2000, entitled METHOD AND APPARATUS FOR SETTING REGISTER ON A MULTICOLOR PRINTING MACHINE, AND MULTICOLOR PRINTING MACHINE.

FIELD OF THE INVENTION

The invention relates to setting register on a multicolor printing machine having color printing units allocated to various printing inks and having image cylinders, equipment for producing images, in particular electrostatic latent images, on the image cylinders, a carrier for printing substrates and image transfer points for the transfer of the color separations from the color printing units to the printing substrates, a time independent allocation of the image productions on the image cylinders being carried out in order to achieve coincidence of register of the color separations in the print.

The invention further relates to apparatus for setting register in accordance with the above-described method on a multicolor printing machine having color printing units allocated to various printing inks and having image cylinders, equipment for producing images, in particular electrostatic latent images, on the image cylinders, a carrier for printing substrates and image transfer points for the transfer of the color separations from the color printing units to printing substrates, sensors for measuring position, and at least one setting device for allocating the positions of the image production points on the image cylinders to the printing substrates in order to achieve coincidence of register of the color separations in the print. Furthermore, the invention relates to an appropriately equipped multicolor printing machine.

BACKGROUND OF THE INVENTION

Printing color illustrations, in particular color images, is carried out by a number of color separations being printed over one another. These are generally the colors yellow, magenta and cyan, as well as black. If required, special colors are added. By overprinting these colors, all color compositions can be achieved, the quality of the prints depending significantly on the in-register overprinting of the color separations. In conventional, non-automated printing processes, the printing plates are corrected by means of test prints and register marks printed at the same time as these until exact overprinting, that is to say, maintenance of register in the print, is achieved.

In digital printing processes, the image cylinders are written with image points by image production equipment in each case, by electrostatic charges being generated and these being provided with adherent colored pigments. The colored pigments are then transferred to a printing substrate. In digital printing processes, maintenance of register can be achieved by the image production equipment being controlled appropriately. Since the setting of an image is carried out anew for each print, it is not necessary, as in conventional printing processes, for a one-off setting to be made, but presetting and control can be provided, which performs corrections for each individual print. Of course, this does not apply only to the application of electrostatic latent images but also to all other printing processes in which image points are applied by a digital control system.

For an electrostatic printing process of the type mentioned at the beginning, U.S. Pat. No. 5,287,162 has, therefore, proposed to print register marks preferably onto the carrier for the printing substrates and to detect these by an apparatus. Here, the times, which the register marks need to pass from production by the image production equipment to a detection point are determined. These times are then used to determine the instants at which the image production equipment perform the image setting on the individual image cylinders, in order to achieve the maintenance of register after the images have been transferred to a printing substrate.

Since achieving coincidence with respect to image setting on the image cylinders leads to inaccuracies if there are differences in speed relating to the surfaces of the image cylinders, U.S. Pat. No. 5,287,162 has proposed to record calibration tables with times which are allocated to various angular positions of the image cylinders, in order, with the aid of these calibration values, to eliminate regularly occurring fluctuations—which are mostly caused by unroundnesses of the cylinders—and in this way to make the corrections for each individual print.

Since the maintenance of register required for high printing qualities requires extremely high precision, such calibration tables, in which time values are set, are inadequate, however. It is not possible to take into account irregularities, which are reflected in differences in time intervals, which cannot be allocated to rotational angles of the image cylinders. Nor is the latter helped either by a proposal in U.S. Pat. No. 5,287,162 to draw up the calibration tables again and again since by this means only the long-term and slow drift of the values can be taken into account, but no short-term differences that cannot be allocated to angular positions of the image cylinders.

A typical example of such irregularities, which are not reflected in differences between time intervals, are fluctuations in the speed of the drive system, since the allocation of the same to specific rotary angles of the image cylinders or other cylinders is not possible, since these fluctuations do not exhibit any synchronism with the angular positions of the image cylinders or other cylinders. Regulation by a calibration table of the type proposed with time values, which is allocated to the rotary angles of the image cylinders, would, thus, rather produce errors than eliminate errors. Thus, in investigations it has been determined, for example, that the poles of the electric drive motors occur as items which cause frequency-type speed fluctuations of the drive, which, because of the different transmission distances, also do not exhibit any synchronous occurrence on all the image cylinders and, therefore, lead to time/position differences on the individual image cylinders. These frequency-type fluctuations are sufficient to cause faults in the register setting. Faults of this type can occur as early as at the start of the image or can make themselves noticeable in the image quality as faults in subareas of images, for example, as register inaccuracies like transverse stripes. Since such frequency-like fluctuations of the drive system are superimposed on other faults, such as unroundnesses of image cylinders, it is no longer possible to draw up calibration tables for correction with a tolerable outlay. These tables could no longer be oriented to the angular positions of the image cylinders or other cylinders for one revolution or for a comprehensible sequence of revolutions, but it would be necessary—if this is at all possible as a result of the complexity—for a curve of calibration values relating to complex machine configurations as far as the occurrence of a repetition situation to be determined. However, drawing up correction values over relatively long time periods in this way is, in turn, opposed by the fact that there are also further causes of faults, such as irregularities in the guidance of the carrier and primarily also long-term changes such as temperature changes, the change in mechanical stresses in the machine, changes in the type of paper, the amount of toner, and so on. Such a "colorful mixture" of faults, which change in the short term and behave synchronously with respect to the angular positions of cylinders, with faults, which likewise change in the short term but not synchronously with the angular positions, and long-term asynchronous changes, oppose the achievement of high precision by a correction with the aid of the proposed calibration tables with time values.

SUMMARY OF THE INVENTION

The invention is, therefore, based on the object of configuring a method, and an apparatus in such a way that high precision of the register setting can be achieved with a tolerable outlay, in particular as far as possible without reject prints. At the same time, both the rapid and most exact possible presetting, as well as a continuous rapid correction of the register setting, is to be made possible.

According to the invention, the object is achieved in that a time-independent allocation of the positions of the image productions on the image cylinders to the printing substrates is carried out for at least one defined area of all the color separations. Further, the object is achieved by the sensors being designed to measure the positions of elements that carry images and substrates, and by at least one setting device being such that it allocates the positions of the image productions on the image cylinders to the printing substrates with regard to at least one defined area of the color separations in a time-independent manner.

With regard to the apparatus, according to the invention, the object is achieved by the sensors being designed to measure the positions of elements that carry images and substrates, and by at least one setting device being designed in such a way that it allocates the positions of the image productions on the image cylinders to the printing substrates with regard to at least one defined area of the color separations in a time-independent manner.

The invention is based on the observation that the presetting and/or regulation of a register, in which recorded times are placed in a relationship with one another, leads to an increase in the complexity of the superimposition of faults, since faults arising from the determination of positions by times are added to the actual register fault causes. This addition of a further fault cause is, therefore, problematical for counter measures, since the last-mentioned faults are faults, which occur in the short term and behave asynchronously in relation to the angular positions of the image cylinders.

The invention is further based on the finding that if, instead of the times, the positions are placed directly in relationship with one another, the faults which do not behave synchronously in relation to the angular positions of the cylinders, for the most part, no longer occur, since they arise from the time-position allocation. They, therefore, do not have any influence on the setting of the register if a direct mutual allocation of positions is made the basis for control or regulation. Such direct position allocations can, for example, be designed in such a way that distances or angular positions are allocated to one another. By the measure according to the invention, the frequency-type fluctuations of the drive system or similar fault sources no longer have any influence on the register setting, since the positions are measured directly and no longer by the circuitous route via times.

The invention achieves the situation where the short-term fluctuations which still remain are repeated essentially synchronously with the angular positions of the image cylinders or other cylinders, as referred to one revolution or a short sequence of revolutions. It is, therefore, also possible to draw up calibration tables for the image production in each color printing unit which apply for a specific time duration. Long-term changes can then be taken into account during printing by calibration tables, which are based on the measurement of positions being renewed again and again. This renewal of calibration tables corrects slow drift. The calibration tables can be drawn up virtually without errors only by means of the measure of the invention, since the short-term faults that behave asynchronously in relation to the angular positions of the image cylinders are, for the most part, avoided and no longer influence the setting of the register based on position allocation. However, the invention is, of course, riot restricted to calibration tables. Calibration tables are only one configuration, but as a result of the invention, these can be used for the first time for precision setting.

The invention makes it possible to measure and to eliminate virtually all fault sources belonging to elements that carry images or printing substrates, since the short-term faults are for the most part reduced to the faults which occur synchronously with angular positions and which, in relation to a repetition per revolution, permit longer-term faults to be separated from the latter. In this case, it does not matter whether the faults, which still remain, are based on the diameter faults or imbalances of image cylinders or further cylinders transferring the images. It is also possible for transfer faults caused by the behavior of elastic material, such as that of cylinder covers, by different contact forces or by differences in mechanical stresses of carriers for printing substrates or the pressure setting of an impression roll which is used for the image transfer to a substrate, to be measured and eliminated, since these faults can be allocated to the angular positions of the respective components that carry images or substrates in a synchronous way, and can therefore be corrected by calibration tables to be drawn up in each case.

There are two possibilities for determining the correction values for the image production. A calibration table can be provided which contains a cycle as far as the occurrence of a repetition. A cycle of this kind can be a revolution or a sequence of revolutions. However, it would be conceivable to draw up calibration tables for other elements that carry images or substrates, relating to all the positions up to the repetition of the same, in order to perform the setting of images on the image cylinder by means of a calculation from the values of all the calibration tables, with the elimination of all the differences which occur in terms of their effect on the positions to be coordinated with one another. By continual determination of the positions during printing, it is also possible for slow drift, for example, as a result of temperature differences and stresses in the machine, to be detected and eliminated. Of course, it is also possible to detect and eliminate faults, which occur as a result of changes in the printing substrate used, changes in the images or in the toner or as a result of other influences.

The allocation of positions according to the invention is possible with or without a calibration table and in various ways. Thus, for example, angular positions or also distances of surfaces of elements that carry images and substrates can be allocated to one another. A combination of angular positions and distances is also possible. One of the elements is expediently taken as a reference. One configuration of the method, therefore, proposes that, for the color separations, in each case the at least one defined area on the image cylinders is produced in relation to predefined positions of the carrier. Another proposal is for at least one defined area of the color separation from a reference printing unit to be assigned to at least one defined area of the color separations from the other color printing units in each case, and for an allocation to a position of the carrier then to be made.

With regard to the apparatus, one proposal is that the at least one setting device be such that it initiates the production of at least one defined area of all the color separations on the respective image cylinders to predefined positions of the carrier. Depending on the aforementioned chosen method, the setting device can also have a different appropriate design.

For the position allocations of the carrier, one proposal provides for the angular positions of the drive roller of the carrier to be used. In addition, the angular positions of the image cylinders can be used for their position allocations. One further possibility is to use the distances of the surface of the carrier for the position allocations of the carrier. In a corresponding way, the distances of the surfaces of the image cylinders can be used for the position allocations of the image cylinder.

With regard to the apparatus, for the use of the angular positions to allocate the positions, it is proposed that at least one sensor be an angular position transmitter, one sensor being proposed for each element whose angular positions are to be measured. Furthermore, at least one setting device must be for the allocation of angular positions. It is additionally possible for at least one sensor for detecting a circularity error to be provided, as well as at least one setting device, which determines the positions from angular positions and circularity errors. The purpose is that it is the actual distances covered by the defined areas of the color separations, which are concerned, and circularity errors lead to the angular positions not being an exact measure of this. An appropriate correction can be made by the proposed detection of the circularity errors, the aforementioned faults being avoided and, nevertheless, the relatively simple measurement of position and allocation of position by the angular positions being possible.

For determining a position by distances, it is proposed that at least one sensor measure distances, one sensor being proposed for each element whose distances are to be measured. In this case, one configuration can have sensors to detect distance marks and the latter being applied to the appropriate surfaces. It is then additionally necessary for at least one setting device to be for the allocation of distances.

For machines, which have additional image transfer cylinders, which are arranged between the image cylinders and the carrier, it is proposed that the positions of image transfer cylinders be included in the position allocations as well. For the allocations of the positions of the image transfer cylinders, their angular positions can be used, or it is possible for the distances of the surfaces of the image transfer cylinders to be used for the allocation of the positions of the same. With regard to the apparatus, in each case at least one sensor must then be provided to measure the positions of the image transfer cylinders, and these positions must be transmitted to at least one setting device for calculating the allocation. The sensor used here can also be both an angular position transmitter, if necessary combined with a sensor for detecting a circularity error, or it is possible for a sensor for measuring distances to be provided.

One configuration of the method according to the invention provides for the mutually assigned defined areas of the color separations to be the image starts. In order to perform this allocation, at least one setting device is such that it predefines the positions of the carrier at which the beginning of image setting on the image cylinders takes place.

In order to achieve exact maintenance of register of the images over all image areas, provision is made for the mutually allocated defined areas to be the areas of the color separations into which the image areas are subdivided. The areas of the color separations can be individual lines of image points or a number of lines of image points of the color separations. In the first case, the lines of image points are allocated to the color separations, in the last-mentioned case, the number of lines of image points is allocated, in order to achieve the coincidence of register. A configuration, which is expedient for the allocation of angular positions, provides for the number of lines of image points of an area to result from the allocation to fixed angular intervals on the image cylinders. Apart from the positions in the direction of movement, however, the lateral position of the areas can also be determined and set. It is preferable also for faults relating to the lateral extent of the areas to be determined and corrected.

In order to perform these settings and corrections, with regard to the method, at least one setting device is such that it predefines the positions of the carrier at which the setting of images on the image cylinders is carried out with the areas into which the image area is subdivided. Here, the areas can be strips, which extend over the image area transversely with respect to the direction of movement. However, for a lateral setting, these strips can also be subdivided transversely again, or a lateral setting is performed which relates directly to the distances between the image points.

A particularly expedient configuration of the invention provides for the positions to be determined by register marks. Determining the positions in this way can be carried out both before carrying out a print, in order to perform the setting, and while a print is being made, in order to carry out corrections to the values. The register marks preferably have elements arranged in the transport direction and spaced apart in a predefined way, the distances being measured. Register marks of this type are printed by each color printing unit, it being possible for the individual elements printed by individual color printing units to form rows or for a number of elements spaced apart to be printed one after another by individual color printing units. The register marks can be ongoing or in groups, it being possible for these again to have defined spacings from one another. As a result, the aforementioned positions can be measured and allocated. If the positions should be measured before printing, it is expedient to print the register marks directly onto the carrier and to remove them again after the determination of position. During printing, it is expedient for the register marks to be printed in the space on the carrier not covered by printing substrates. However, it is also possible to print the register marks on paper, which can be a test sheet, or it is possible for this purpose to use image-free edges of the printing substrates. With regard to the apparatus, at least one sensor can be provided for detecting register marks. Said sensor is expediently designed in such a way that it measures the distances between elements of the register marks which are spaced apart in a predefined way.

Following the measurement of the data for all the color printing units, the deviations of the actual values from the desired values for the image starts are expediently separated from the deviations of the actual values from the desired values for the other areas into which the image areas are subdivided, by an appropriately programmed computing device by an analysis of the measured positions. The values are then given to setting devices for the image starts and to setting devices for the defined areas of the color separations. These setting devices are equipped with machine-specific nominal values, being such that, before the start of printing, they take into account correction values for determining the positions on the image cylinders, if the machine is one in which the image cylinders transfer the image directly to the substrates, then, in this case, the distance from the image production points as far as the image transfer points to the image cylinders is decisive. If the machine is one which has image transfer cylinders, then the distance from the image transfer point between image cylinder and image transfer cylinder as far as the image transfer point to the substrate is added. Furthermore, the setting devices can be such that, after the start of printing, they take into account correction values for the positions.

It is preferable if, following the measurement of the positions for the image starts on the individual image cylinders, these positions for the image production of the other defined areas on the individual image cylinders are measured such that they are linked with the first and used in this sequence for control or regulation. In this way, firstly the register of the position of the beginning of the color separations and then the position for individual image areas are set.

It is advantageous if, in the case of the measured values, noise, that is to say, fluctuations that occur in the very short term, are eliminated for the evaluation (in order to avoid control instability). In addition, the other fluctuations in the measured position values, which, with regard to their order of magnitude and repetition, can be allocated to a repeatable position of a cylinder, are separated from longer-term fluctuations. The fluctuations in the measured position values which, with regard to their order of magnitude and repetition, can be allocated to a repeatable position of an image cylinder, are entered into at least one calibration table for this image cylinder and used for the fault-compensating control of the positions of the image production points for producing the images of the respective image cylinder. The calibration tables are expediently drawn up both for the image starts of the color separations and for the defined areas of the color separations.

In addition, for the further elements that carry images or substrates, deviations which can be allocated to their repeatable positions in a movement cycle of the actual positions from the desired positions are measured and included in the calculation of the image production points in order to eliminate these deviations. These are, for example, the image transfer cylinders in the case of appropriately configured machines. In addition, calibration tables can be drawn up for such elements that carry images or substrates, in order then to include all the calibration tables in the calculation of the positions of the image production points. Longer-term fluctuations which cannot be allocated to repeatable positions of a movement cycle are taken into account by ongoing renewal of the calibration tables. The calibration tables are corrected before each print job, but it is also possible to correct them continuously during printing.

With regard to the apparatus, such calibration tables can be available in appropriate files for controlling the setting devices. Such files are initially available as machine-specific nominal values, and are taken into account by setting devices, even before printing is started, as correction values for the positions of the image productions on the image cylinders. Likewise, such correction values can be taken into account for the positions on the image transfer cylinders, the latter correction values likewise being implemented via a correction of the image productions on the image cylinders in order to achieve maintenance of register. A print is then made, register marks expediently being printed first before the print job is carried out and their position being measured, in order to take into account the correction values determined in this way for determining the positions of the image productions. After that, register marks can also be printed at the same time during the processing of a print job, in order to detect changes and to be able to make further corrections.

Boundary conditions which have an influence on the register should be taken into account in as timely a manner as possible by corrections to the position values. For good print quality and the avoidance of rejects, it is, therefore, desirable to include such changes as early as possible in the calculation of the position values. For this reason, it is proposed that errors in the measured position values which occur in the longer term and cannot be allocated, by their repetition, to a repeatable position of an element that carries an image or substrate, be taken into account by detecting and including the influencing variables which cause them in the correction for the register control. This detection and inclusion of the influencing variables in the correction is expediently carried out on the basis of stored values from experience. For this purpose, the setting devices are such that, before the start of printing, they take into account correction values for the measurement of the positions which can be allocated to detectable influencing variables, and are available as at least one selectable files with values from experience. The choice of such a file can be made via an input device, that is to say activated by a manual input, or it is also possible for the choice to be made by a setting device on the basis of at least one measurement of at least one influencing variable, that is to say the inclusion of a file for correction is activated by a measurement of the influencing variable. Furthermore, an influencing variable can be measured in terms of its effect on the register, and a correction to the image production can be made in accordance with these deviations.

There are numerous influencing variables of this type, which are related to the print job or environmental influences, which one, therefore, knows or which can be measured. One example of this is the temperature at specific locations in the printing machine. In order to take this into account, it is proposed that at least one temperature sensor be arranged in the printing machine, and the measured temperatures be made the basis for a correction. Mechanical stresses on specific machine parts of the printing machine can also be of influence for the maintenance of register. It is, therefore, proposed, that this influencing variable be detected by arranging at least one stress sensor, and that the measured values be made the basis for a correction.

A further influencing variable is the paper grade, in this case the values from experience for the respective paper grade are stored and, when a new paper grade is fed in, reference is made back to the appropriate file. The toner profile of the image to be printed also has an influence, it being possible to take this into account by the color printing machine being equipped with a device for measuring a toner profile, or the latter being measured in advance and input into the controller. It is then expedient for values from experience for different toner profiles to be available.

Since, during printing, displacement of a substrate on the carrier can occur, it is also possible to detect this and to correct the image productions in order to compensate for such a displacement. With regard to the apparatus, it is proposed that a sensor be provided for detecting a displacement of a substrate on the carrier, and the setting devices be such that the positions of the image productions be corrected in order to compensate for this displacement.

Further values from experience can be available for various image widths or for various paper widths, in order to carry out the appropriate corrections. It is also possible for values from experience for changes in the substrate dimensions following image setting on one side to be taken into account in order that the image size of the verso print corresponds to the image size of the recto print. As a result, changes in the substrate dimensions as a result of flexure of the same during printing, as a result of the application of color or as a result of the fixing of the colors by fusing can be taken into account.

By values from experience, the retroactive influence of the state preceding a change can also be taken into account. Such a retroactive effect occurs, for example, in the case of a paper grade change when the image cylinder is already having the image for the new paper grade set while the preceding image is still being printed on the previous paper grade.

In addition to the aforementioned corrections, however, others are also conceivable. Provision can, thus, be made for fluctuations in the position values which, with regard to their repetition, cannot be allocated to the angular position of an image cylinder but occur repeatedly and regularly, are entered into separate calibration tables and used for the fault-compensating control of the device for producing the images on the respective image cylinder. For example, fluctuations in the position values which, with regard to their repetition, cannot be allocated to the position of the carrier for the printing substrates, can be corrected in accordance with the position of the carrier, this correction being added to the corrections of the position of values which can be allocated to the position of the image cylinders, and being taken into account for the position at which the color separations are produced on the image cylinders. Of course, fluctuations in the position values can also be avoided by ruling out their causes.

For example, with regard to the carrier, provision can be made for its periodically occurring irregularities to be measured in advance and set into the calculation, or it is also possible for the circumference of the drive roller of the carrier to be dimensioned, in relation to the spacing between the image transfer points of the color printing units, in such a way that the allocation of the angular positions of the drive roller to the image cylinders repeats. This may be implemented by it being possible for the circumference of the drive roller of the carrier to be inserted into the distance between the image transfer points of the color printing units. In this case, it may be possible to insert it as a half or preferably as a whole number. A development of this type is primarily expedient when the drive roller drives the image cylinders via the carrier and possibly via the image transfer cylinders, since irregularities resulting from unroundness of the drive roller then act simultaneously on all the color printing units and can no longer influence the register setting. The aforementioned configuration is also expedient when the distances of the carrier are measured by means of an angular position transmitter belonging to the drive roller, since the differences in speed of the carrier which are not registered by the angular position transmitter and result from unroundnesses of the drive roller no longer have to be measured either, since their influence has already been ruled out in the aforementioned way.

It is often the case that a completely exact determination of the position values on the basis of the measured data is not possible. For example, measurements usually have a certain scatter, they can exhibit differences over the image width, or short-term fluctuations arise as a result of oscillations. For such cases, it is proposed that, within a tolerable bandwidth of measured distance values, the correction is set to a central range. For example, in the case of various position values transverse to the transport direction, an average value can be set. Here, it is possible that, in order to calculate the average value, for the measured deviations to be weighted, quadratic weighting being proposed as an example. Other weightings are, of course, possible, being made in view of the fact that the influence of the deviations on the image quality is at a minimum. Expediently, the values from the color printing units, which lie in the central range, are brought into alignment with the value from a reference printing unit that lies in the central range.

With regard to the calculation of the positions of the image cylinder in which the images are produced, it is proposed that the arrival of a printing substrate be detected and then the positions for the respective beginning of setting the image on the image cylinders being determined as positions, for example, as distances of the carrier beginning from a detection point for printing substrates. These calculations are initially made on the basis of the values previously determined and input, subsequent corrections being made by at least one device determining the corrections to the positions necessary on the basis of measuring the positions during printing, and transmitting these to the setting devices to be implemented.

Since an analysis of the measured values can be made, in a manner already proposed, to the effect that the differences in position for the image starts are separated from the differences in position for the remaining areas into which the image areas are subdivided, with regard to the apparatus for setting register, it is proposed that at least one device for determining the corrections for the image starts be connected to the sensor for measuring the positions of the carrier and to the sensor for detecting the register marks. In this way, the device for determining the corrections is given the data relating to the deviations of the positions of the register marks from the previously calculated positions, and as a result can calculate and initiate the corrections.

In addition, it is proposed that a device for determining the corrections for the areas of the color separations into which the image areas are subdivided be connected to the sensor for measuring the positions of the carrier and to the sensor for detecting the register marks. In this way, the differences between the precalculated positions from the positions registered by the register marks can also be measured for the areas of the color separations into which the image areas are subdivided, and the corrections can be calculated.

The starting signal for the image starts is linked with the start of the other areas into which the image areas are subdivided, by a device for the output of starting signals for the image starts simultaneously giving starting signals to devices for the allocation of the areas into which the image area is subdivided, this device being connected to the sensor for measuring the positions of the image cylinders and allocating to these positions the areas into which the image area is subdivided.

In order to have sufficient time available for calculating the positions needed for precise register setting, it is further proposed that a sensor for detecting a printing substrate which is fed to the printing machine be arranged on the distance of the printing substrates to the printing machine and be connected to the setting devices, the calculation of the mutual allocation of the positions of the image production points being started when a printing substrate is detected. Since this sensor on the distance of the printing substrates to the printing machine cannot detect their leading edge exactly enough, it is also proposed that a sensor for the accurate detection of leading edges of printing substrates be arranged on the carrier and connected to devices which calculate the distances which the printing substrate covers from this sensor as far as the positions of the beginning of the respective image setting process, in order then to initiate the beginning of the image setting in the correct position. However, it is of course also possible for a sensor, which is arranged on the carrier to perform both functions, if an adequate distance is available.

In addition, the multicolor printing machine, proposed in accordance with the invention, can have all of the above-described apparatus features and can be such that it can operate in accordance with all the above-described method features.

BRIEF DESCRIPTION OF THE DRAWINGS

The invention will be explained below using an exemplary embodiment, which is illustrated in the drawing, in which.

DETAILED DESCRIPTION OF THE INVENTION

Figure 1:
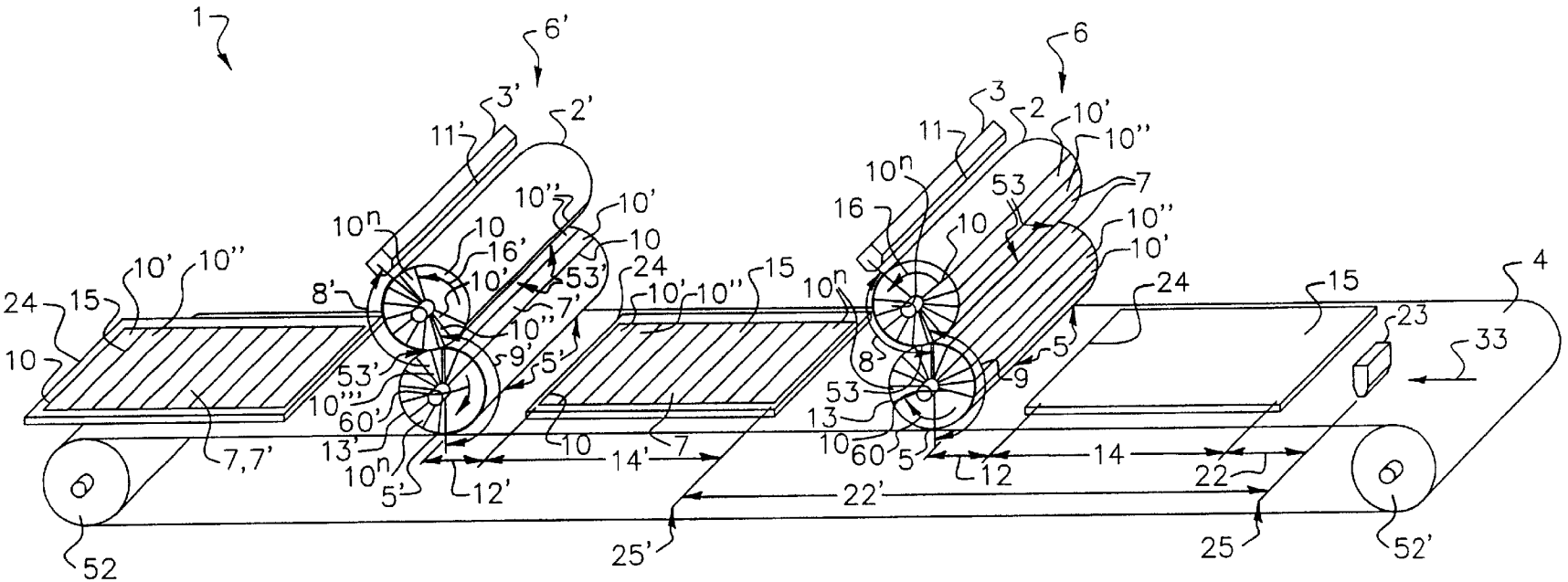
FIG. 1 shows a schematic illustration of the function of a multicolor printing machine according to the invention.
Figure 4:
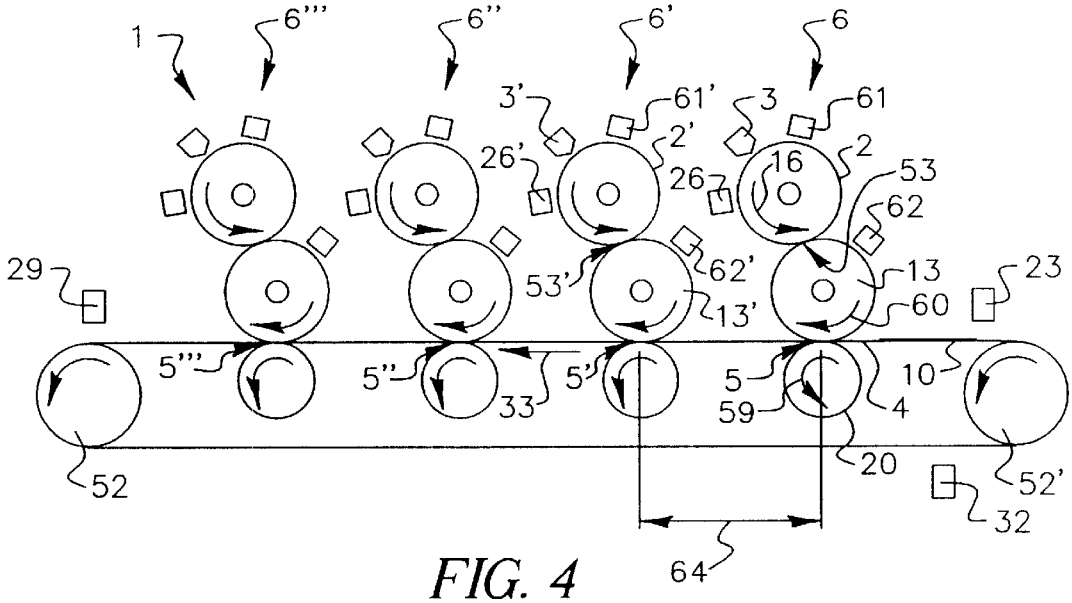
FIG. 4 shows a schematic illustration of a multicolor printing machine having four color printing units.

FIG. 1 shows a schematic illustration of the function according to the invention of a multicolor printing machine 1. As a rule, multicolor printing machines 1 have four color printing units 6, 6', 6", 6'", as illustrated in FIG. 4. In the illustration of FIG. 1, only two color printing units 6 and 6' have been shown, since this is sufficient to explain the function according to the invention. The illustration must be expanded intellectually to the effect that, in the normal case, four or sometimes even more color printing units 6, 6', 6", 6'" have to be brought into coincidence of register in the manner described.

Each of the color printing units 6, 6', . . . illustrated has an image cylinder 2, 2', . . . , to which an item of equipment 3, 3', . . . for producing images is allocated. This is generally digital image production, in the form of electrostatic latent images, or by direct or other digital image production, such as for example by an ink jet. Multicolor printing machines 1 can be such that the transfer of the images from the image cylinders 2, 2', . . . takes place directly to printing substrates 15. However, the multicolor printing machine 1 illustrated also has image transfer cylinders 13, 13', . . . , the images being transferred from the image cylinders 2, 2', . . . to the image transfer cylinders 13, 13', . . . at image transfer points 53, 53', . . . . From the image transfer cylinders 13, 13', . . . , the images are then finally transferred to the printing substrates 15 at image transfer points 5, 5', 5", 5'".

The printing substrates 15 are transported in the direction of the arrow 33 by a carrier 4. In the process, they pass the image transfer points 5, 5', 5'", 5'" one after another. At each image transfer point 5, 5', 5", 5'" of a color printing unit 6, 6', 6", 6'", a color separation 7, 7', . . . is transferred to the printing substrate 15. The problem to be solved by register settings is that the color separations 7, 7', . . . have to be printed on one another extremely exactly in order to achieve high print quality. In the case of electrostatic or similar digital printing processes, the images on the image cylinders 2, 2', . . . are produced anew for each individual print by means of equipments 3, 3', . . . , and subsequently removed again by a device 61, 61', . . . Such a device 61, 61', . . . is shown in FIGS. 2 and 4.

Figure 2:
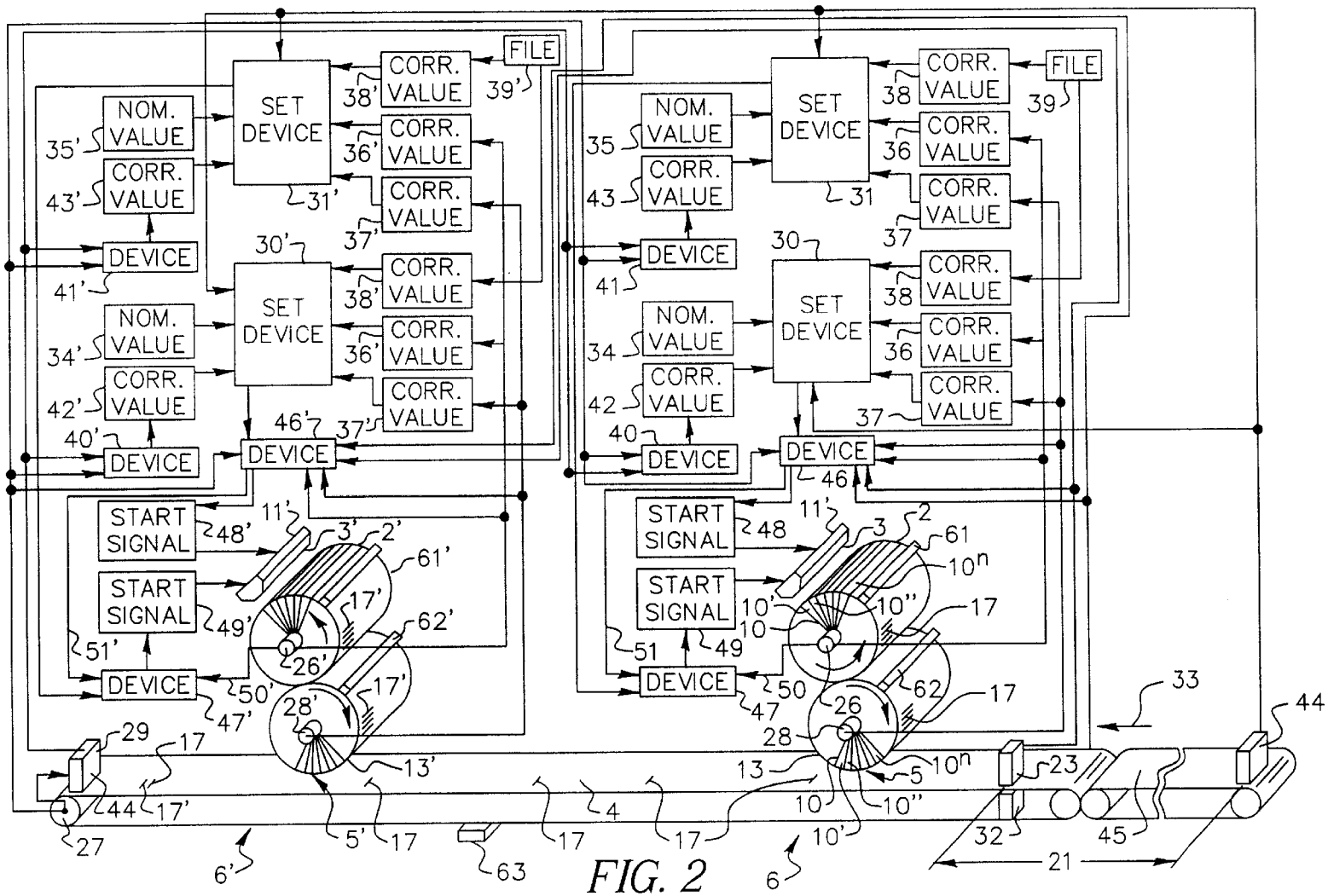
FIG. 2 shows the basic construction of a register setting apparatus of the multicolor printing machine according to the invention.

For better clarity, not all the components of the machine have been shown in all the figures, but the illustrations of FIGS. 1, 2 and 4 represent an exemplary embodiment and are to be combined to form a machine illustration in order to achieve completeness.

Since images can be set on the image cylinders 2, 2', . . . at freely selectable image production points 11, 11', . . . , the setting of register in printing machines with digital printing processes is carried out by the image production points 11, 11', . . . on the individual color printing units 6, 6', 6", 6'" being chosen in such a way that maintenance of register is achieved as the images are transferred to the printing substrates 15. According to the prior art, for this purpose times were recorded which a printing substrate needs until it reaches the image transfer points. These times were brought into alignment with the times, which an image needs from its production as far as its transfer to the printing substrate. A detection of a printing substrate was therefore carried out, and then, for each color printing unit, the instant for image setting was calculated in such a way that the maintenance of register of all the color separations is thereby achieved.

In order to achieve coincidence of register of the color separations 7, 7', . . . , the invention then provides that the positions of the production 11, 11', . . . of the color separations 7, 7', . . . are brought into alignment with one another and with the positions 25, 25', . . . of a printing substrate 15. In this case, all the positions 11, 11', . . . ; 8, 8', . . . ; 9, 9', . . . ; 12, 12', . . . ; 14, 14', . . ; 22, 22', . . . ; 25, 25', . . . can be defined as distances or as angular positions and used for calculating the positions of the production 11, 11', . . . of the color separations 7, 7' . . . .

For example, it is possible for the distances 8, 8', . . , 9, 9', . . . of the color separations 7, 7', . . . from the image production points 11, 11', . . . of the equipment 3, 3', . . . for producing images as far as the image transfer points 5, 5', 5", 5'" to-be brought into alignment with the distances 12, 12', . . . ; 14, 14', . . . ; 22, 22', . . . of a printing substrate 15 on the carrier 4. The distances 12, 12', . . ; 14, 14', . . . ; 22, 22', . . . are covered by the printing substrate 15 with the carrier 4 from a detection point 23 as far as the image transfer points 5, 5', 5", 5'" of the printing units 6, 6', 6", 6'". Such an allocation can be carried out in an appropriate way by using the angular positions 8, 8', . . . of the image cylinders and the angular positions 9, 9', . . . of the image transfer cylinders 13, 13' . . . . In addition, the distances 12, 12', . . . ; 14, 14', . . . of the carrier 4 can be measured as angular positions 12, 12', . . . ; 14, 14', . . . of the drive roller 52 of the carrier 4 and used for the settings. In order to characterize the aforementioned and further types of position determinations, in the following text mention will be made of positions 11, 11', . . . ; 8, 8', . . . ; 9, 9', . . . ; 12, 12', . . . ; 14, 14', . . . ; 22, 22', . . . ; 25, 25', . . . .

In order to achieve accuracy of register, on the one hand the image starts 10 of the color separations 7, 7', . . . are brought into alignment, and on the other hand, however, defined areas 10', 10", . . . , 10$^{n}$ n of the color separations 7, 7', . . . are also brought into alignment. The latter serves to maintain the register accuracy achieved at the image starts 10 over the entire printed image.

The allocation of positions according to the invention begins with a sensor 23, which serves as a detection point for the leading edge 24 of a printing substrate 15. However, it is possible to move the computing operation for the allocation of the color separations 7, 7', . . . of the individual color printing units 6, 6', 6", 6'" forward, by a sensor 44 (FIG. 2) for detecting a printing substrate 15 to be arranged upstream of the carrier 4, in order to detect printing substrates 15 which are fed to the printing machine 1 already on their way to the printing machine 1, and to start up the computing operation for the allocation of the color separations 7, 7' . . . .

The apparatus for setting register calculates the positions 25, 25', . . . , starting from the detection point of sensor 23, for example as distances 22, 22', . . . which the printing substrate 15 must cover on the carrier 4. These positions 25, 25', . . . are defined by the fact that when they are reached by a printing substrate 15, the setting of an image on the image cylinders 2, 2', . . . begins. The positions 25 and 25' are, so to speak, the positions at which the distance of the leading edge 24 of a printing substrate 15 is equal to the leading edge 10 of the color separations 7, 7', . . . as far as the image transfer points 5, 5', 5"and 5'"—or equality of angles expressed in the abovementioned angles. Of course, it is normally the case, as shown in FIG. 4, that at least four color printing units 6, 6', 6", 6'" must be brought into this coincidence of positions. To this extent, FIG. 1 constitutes a simplification.

When the positions 25, 25', . . . of the start of the image setting are then reached, the image start 10 has to cover the same distance as the leading edge 24 of the printing substrate 15. However, consideration has not been given to the fact that the printing substrate may have a print-free edge, which would then, of course, have to be included in the calculation. If, starting from the positions 25, 25', . . . a printing substrate 15 covers the distances or angles 14, 14', . . . (e.g. of the drive roller 52), then the color separations 7, 7', . . . on the image cylinders 2, 2', . . . cover the distances or angles 8, 8', . . . . The image transfer 53, 53', . . . to the image transfer cylinders 13, 13', . . . then takes place. The further distances or angles 9, 9', . . . of the color separations 7, 7', . . . on the image transfer cylinders 13, 13', . . . then correspond to the distances or angles 12, 12', . . . of the printing substrate 15 on the carrier 4. In this way, when the printing substrate 15 arrives at the respective image transfer points 5, 5', 5", 5'", in each case the appropriate color separation 7, 7' is "supplied" not "just in time" but in an identical position. As a result, the printing substrate is given the first color separation 7 in its transport direction 33 at the color printing unit 6, and then the second color separation 7' at the second printing unit 6' and so on. In FIG. 1, therefore, the printing substrate 15 on the right still does not bear a color separation, the central printing substrate 15 bears the color separation 7 from the color printing unit 6, and the left-hand printing substrate 15 bears both color separations 7 and 7'. Printing is then completed at further color printing units 6" and 6'" and, if necessary, further by special colors. The transport of the printing substrate 15 is in this case provided by means of the carrier 4, which is designed as a belt running on rollers 52 and 52'. One roller is the drive roller 52 and the other roller is a guide roller 52'. In order to transfer the color separations 7, 7', . . . to the printing substrates 15, impression cylinders 20 are fitted at the image transfer points 5, 5', 5", 5'". These cylinders serve to transfer the electrically charged color particles to the printing substrates 15 in the printing process with electrostatic latent images. They are not shown in FIGS. 1 and 2 but their position can be taken from FIG. 4.

Also shown in FIG. 1 are the directions of rotation 16, 16', . . . of the image cylinders 2, 2', . . . and the directions of rotation 60, 60', . . . of the image transfer cylinders 13, 13', . . . . The conveying direction of the carrier 4 is shown by the arrow 33.

FIG. 2 shows the basic construction of a register setting apparatus for implementing the setting according to the invention of the positions 8, 8', . . . ; 9, 9', . . . ; 12, 12', . . . ; 14, 14', . . . ; 22, 22', . . . ; 25, 25', . . . . In order to be able to allocate positions to one another, it is first of all necessary to measure all the elements, which assume relevant positions for the image or substrate transport. This is firstly the carrier 4 for the printing substrates 15. Its positions can be measured by a sensor 27, which is an angular position transmitter. Alternatively, however, a sensor 32 which detects distance markings on the carrier 4 can also be arranged on the carrier 4. In addition, the detection of register marks 17, 17', 17", 17'" by a sensor 29 can be used to measure the position. In order to measure the positions of the image cylinders 2, 2', . . . , in the exemplary embodiment illustrated use is made in each case of a sensor 26, 26', . . . an angular position transmitter, and for measuring the position of the image transfer cylinders 13, 13', . . . , of sensors 28, 28', . . . likewise angular position transmitters. However, sensors 26, 26', which measure the distance by distance markings, can also be arranged on the cylinders 2, 2', . . . ; 13, 13', . . . . This is indicated in FIG. 4 by the arrangement of such sensors 26, 26', . . .

Arranged upstream of the carrier 4 is a transport belt 45 for feeding printing substrates 15 to the printing machine 1. When a printing substrate 15 passes the sensor 44, then the calculation of the allocations of the positions 8, 8', . . . , 9, 9', . . . ; 12, 12', . . . ; 14, 14', . . . ; 22, 22', . . . ; 25, 25', . . . is begun. When the leading edge 24 of the printing substrate 15 then arrives at the sensor 23, the calculations are ready, and devices 46, 46' are started up which register the covering of the distances 22 and 22' and then give the starting signals 48 and 48' for the image starts 10 and starting signals 49 and 49' for the areas 10', 10", . . . , 10$^{n}$ of the color separations 7, 7'. In order to measure the distances 22, 22', . . . or detect the fact that the positions 25, 25', . . . have been reached, in order to be able to give the starting signals 48, 48', . . . ; 49, 49', . . . , the devices 46, 46', . . . are connected to all the sensors which measure positions. These are the sensors 26, 26', . . . for measuring the positions of the image cylinders 2, 2', . . . , the sensor 27 for measuring the positions of the carrier 4, and the sensors 28, 28', . . . for measuring the positions of the image transfer cylinders 13, 13', . . . . In addition, the devices 46, 46', . . . for calculating the positions 25, 25', . . . are connected to setting devices 30, 30', . . . , which calculate the positions 12, 12', . . . and 14, 14', . . . for the image starts 10. The starting signals 48, 48', . . . for the image starts 10, and the starting signals 49, 49', . . . for the areas 10', 10", 10'", . . . , 10$^n$ of the color separations 7, 7', . . . into which the image area is subdivided, are given when the leading edge 24 and, respectively the future start of the image on the printing substrate 15 have reached the positions 25, 25', . . . of the beginning of the image setting on the image cylinders 2, 2', . . . . In this regard, reference is made to FIG. 1.

Since the starting signals 49, 49', . . . for the areas 10', 10", . . . , 10$^n$ must be allocated exactly to the positions of the image cylinders 2, 2', . . . , there is a connection 50, 50', . . . between the devices 47, 47', . . . and the sensors 26, 26', . . . for measuring the positions of the image cylinders 2, 2', . . . . The connections 51, 51', . . . between the devices 46, 46', . . . and the devices 47, 47', . . . are used for the purpose of starting the areas 10', 10", . . . , 10$_n$ at the same time as the image starts 10. The devices 47, 47', . . . are used to allocate the areas 10', 10", . . . , 10$^n$ of the color separations 7, 7', . . . to the positions of the image cylinders 2, 2', . . . .

For the calculation of the positions 8, 8', . . . ; 9, 9', . . . ; 12, 12', . . . ; 14, 14', . . . ; 22, 22', . . . ; 25, 25', . . . of the defined areas 10, 10', 10", . . . , 10$^n$, use is made of setting devices 30, 30', . . . ; 31, 31', . . . . In this case, the setting devices 30, 30', . . . are used for calculating the distances 8, 8', . . . ; 9, 9', . . . of the image starts 10, and the setting devices 31, 31', . . . are used for the calculations of the distances 8, 8', . . . ; 9, 9', . . . of the areas 10', 10", . . . , 10$^n$ of the color separations 7, 7', . . . . The setting devices 30, 30', . . . ; 31, 31', . . . are provided and interlinked in such a way that they are given all the information needed for the calculations of the positions and are, thus, able to give such commands to the equipment 3, 3', . . . producing the images that the image production points 11, 11', . . . , correspond in terms of their respective position, to the coordination of the positions 8, 8', . . . ; 9, 9', . . . , with the positions 12, 12', . . . ; 14, 14', . . . . This coordination is carried out both before a printing substrate 15 is printed by machine-specific nominal values, with a correction by the print, and by detecting register marks 17, 17', 17", 17", and also during the printing of printing substrates 15, it being possible for register marks 17, 17', 17", 17'" to be detected here as well. In this way, corrections to the presettings are possible between each individual image setting operation. Following the transfer of the color separations 7, 7', . . . from the image cylinders 2, 2', . . . to the image transfer cylinders 13, 13', . . . , the image residues are removed from the image cylinders 2, 2', . . . again by devices 61, 61', . . . . Likewise, the image transfer cylinders 13, 13', . . . are allocated such devices 62, 62', . . . for removing the image residues.

A first setting of the positions for the image productions 11, 11', . . . is performed by the setting devices 30, 30', . . . ; 31, 31', . . . receiving all the relevant data 8, 8', . . . ; 9, 9', . . . ; 12, 12', . . . ; 14, 14', . . . ; 22, 22', . . . ; 25, 25', . . . . In order to make this data available, it is not necessary to print on a substrate 15, indeed no printing process is needed at all, since the measurement and allocation of the positions, for example of the distance or angles 8, 8', . . . ; 9, 9', . . . and 12, 12', . . . ; 14, 14', . . . ; 22, 22', . . . ; 25, 25', . . . is sufficient.

At first, the setting devices 30, 30', . . . have machine-specific nominal values 34, 34', . . . of the positions 8, 8', . . . ; 9, 9', . . . of the image starts 10. The setting devices 31, 31', . . . likewise have machine-specific nominal values 35, 35', . . . , specifically those relating to the positions 8, 8', . . . ; 9, 9', . . . of the areas 10', 10", . . . , 10$^n$ of the color separations 7, 7', . . . . These machine-specific nominal values 35, 35', . . . are corrected continually in order to achieve high accuracy, and for the first time before a printing operation is carried out. For this purpose, the setting devices 30, 30', . . . ; 31, 31', . . . are given correction values 36, 36', . . . relating to the positions 8, 8', . . . on the image cylinders 2, 2', . . . by the sensors 26, 26', . . . for measuring the positions of the image cylinders 2, 2', . . . . In addition, the setting devices 30, 30', . . . ; 31, 31', . . . are given correction values 37, 37', . . . for the positions 9, 9', . . . of the image transfer cylinders 13, 13', . . . . These correction values 37, 37', . . . originate from the sensors 28, 28', . . . for measuring the angular positions or the distances of the surfaces of the image transfer cylinders 13, 13', . . . . The distances 64 between the color printing units 6, 6', 6", 6'" and the position of the sensor 23 can also be input as machine-specific nominal values. Corrections to the same can be necessary on the basis of various influences, for example, on the basis of measured temperatures or on the basis of mechanical stresses in the printing machine 1.

However, since further circumstances have an influence on the calculation of the distances, the setting devices 30, 30', . . . ; 31, 31', . . . are also supplied with further correction values 38, 38', . . . . These correction values 38, 38', . . . may be values from experience for paper grades, for the toner application, image widths, paper widths, the fact that verso printing is being carried out, temperature, stresses in machine parts, the displacement of a printing substrate 15 on the carrier 4 and so on. In this regard, reference is made to the above description. These correction values 38, 38', . . . are available as values from experience. They can be given to the setting devices 30, 30', . . . ; 31, 31', . . . by means of an input device (not illustrated), or it is possible to transmit them to the setting devices 30, 30', . . . ; 31, 31', . . . on the basis of a measurement, for example of a temperature or a stress.

Both the machine-specific nominal values 34, 34', . . . ; 35, 35', . . . and the correction values 38, 38', . . . may be available as calibration tables. In this case, the machine-specific nominal values 34, 34', . . . ; 35, 35', . . . are allocated to the angular positions, preferably of the image cylinders 2, 2', . . . . However, other allocations already described above are possible; in that case a number of calibration tables have to be included when calculating the image production points 11, 11', . . . . on the image cylinders 2, 2', . . . . Calibration tables for other values are then allocated, for example, to different temperatures or different stresses. In addition, these calibration tables can also be allocated to angular positions of the image cylinders 2, 2', . . . . The correction values 38, 38', . . . stored as values from experience are stored such that they can be called up as files 39, 39', . . . .

On the basis of a test operation, or during printing, it is possible to take into account further corrections as feedback. These further corrections may be determined, for example, by register marks 17, 17', 17", 17'" being printed onto the carrier 4 by the color printing units 6, 6', 6", 6'" and being detected by a sensor 29 for detecting the register marks 17, 17', 17", 17'". In the case of these register marks 17, 17', 17", 17'", it is essential that they are also allocated to the carrier 4 by their positions and, for example, have regularly spaced elements 18. In this case, a row of spaced elements 18 can be printed, in which in each case one element 18 is printed successively by a color printing unit 6, 6', 6", 6'". However, it is also possible for color printing units 6, 6', 6", 6'" to print a number of spaced elements 18 one after another. If the register marks 17, 17', 17", 17'" are not printed as ongoing bands, then the distances between the individual groups of register marks can also be measured. The register marks 17, 17', 17", 17'" can be printed directly onto the carrier 4 if there are still no printing substrates 15 on the latter. They can be printed onto the points on the carrier 4 which are not covered by printing substrates 15, onto test sheets or onto image-free points on the printing substrates 15, for example, onto the edges.

The measured values from the sensor 29 are transmitted to devices 40, 40', . . . for determining the corrections 42, 42', . . . for the image starts 10, these devices 40, 40', . . . giving the corrections 42, 42', . . . to the setting devices 30, 30', . . . . In a corresponding way, the values from the sensor 29 for detecting the register marks 17, 17', 17", 17'" are given to devices 41, 41', . . . for determining the corrections 43, 43', . . . for areas 10', 10", . . . , 10$^n$ of the color separations 7, 7', . . . . These devices 41, 41', . . . also give the corrections 43, 43', . . . to the setting devices 31, 31', . . . in order that the positions for the defined areas 10', 10", . . . , 10$^n$ can be corrected there on the basis of this feedback.

Of course, the illustration of FIG. 2 has also been restricted, for reasons of clarity, to only two printing units 6, 6'. In fact, there are generally four printing units 6, 6', 6", 6'". Of course, it is then necessary for the carrier 4 to be configured to be correspondingly longer. In addition, the transport belt 45 for feeding a printing substrate 15 to the printing machine 1 is illustrated in shortened form, the distance 21 of a printing substrate from the sensor 44 to the sensor 23 is significantly longer, in order to be able to carry out the computing operation for the positions 8, 8', . . . ; 9, 9', . . . ; 12, 12', . . . ; 14, 14', . . . ; 22, 22', . . . ; 25, 25', . . . as this distance is covered. Since there are normally four printing units 6, 6', 6", 6'", the above-described elements allocated to the printing units 6 and 6' illustrated are also present four times. Alternatively, a computer is provided which contains all the elements.

Figure 3A:
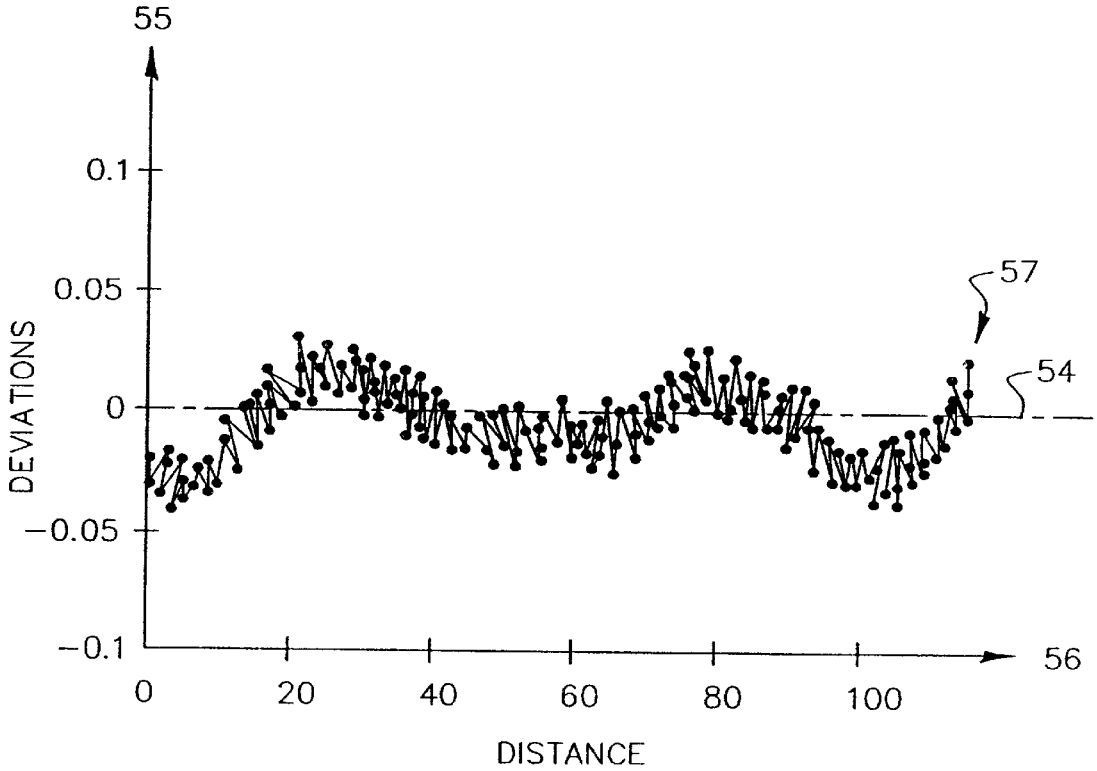
FIG. 3a (PRIOR ART)
FIG. 3*a* shows register deviations in a machine, which has been set on the basis of a time measurement.

FIG. 3*a* shows register deviations in a machine, which has been set on the basis of a time measurement. The deviations 55 from the desired value 54 of a register in the case of measured points being measured along a distance 56 in the transport direction 33 are plotted. As can be seen, the measured points 57 exhibit oscillation-like deviations from the desired value 54, which is illustrated as a zero line.

Figure 3B:
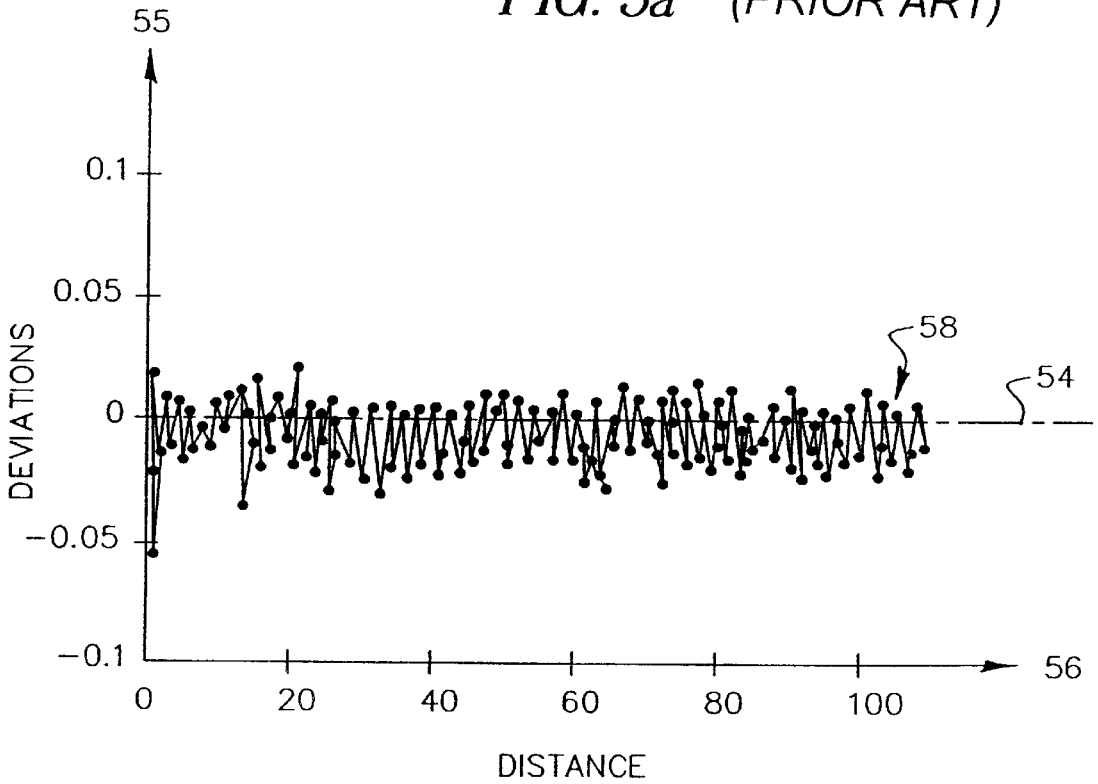
FIG. 3*b* shows register deviations in a machine, which has been set in accordance with the principle of the invention.

FIG. 3*b* shows register deviations in a printing machine 1, which have been set in accordance with the principle of the invention. By the register setting carried out there in accordance with positions, a setting with significantly lower deviations is achieved. Here, too, the deviations 55 from the desired value 54 are plotted against the distance 56 from measured points along the transport direction 33. The oscillation-like deviations like those in the case of time control do not occur here, even when the cause, for example, the poles of the electric motor of a drive machine, is still present. The reason for this is that oscillations of this type are based on the allocation of positions to times, and therefore cannot influence any control.

FIG. 4 shows a schematic illustration of a multicolor printing machine 1 having four color printing units 6, 6', 6", 6'". This is the normal construction of a multicolor printing machine 1, but there can also be still more printing units. The reference symbols are identical to those already described, all the illustrated components of the machine having already been discussed in the embodiments relating to FIGS. 1 and 2. The printing machine illustrated as an exemplary embodiment has the four color printing units 6, 6', 6", 6'", each being allocated the elements according to FIGS. 1 and 2.

In addition, the distance 64 between two color printing units 6, 6'or 6', 6" or 6", 6'" is also shown here. Such a distance 64 is expediently measured such that any unroundness of the drive roller 52 has a simultaneous influence on all the printing units 6, 6', 6", 6'". As a result of this uniform influence, the effect of this fault is avoided. For this purpose, the circumference of the drive roller 52 may correspond to the distance 64, but can also be a fraction of this distance 64 or a whole multiple. From the point of view of dimensioning the machine, the identity of the circumference with the distance 64 or a whole multiple might be considered.

Figure 5:
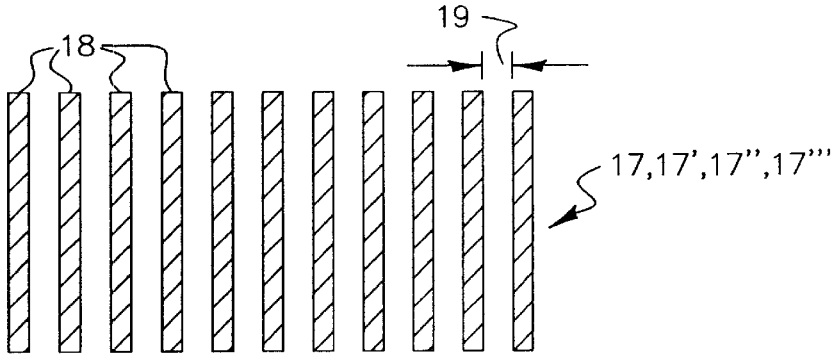
FIG. 5 shows a register mark for a position measurement.

FIG. 5 shows register marks 17, 17', 17", 17'" which are particularly expedient for measuring positions. These register marks 17, 17', 17", 17'" have spaced elements 18. They constitute, so to speak, a scale which defines positions as distance or indicates them, for example, as an angular interval and, thus, makes it possible to measure the position of the color separations 7, 7', 7", 7'" in relation to one another and to the printing substrate 15.

Figure 6:
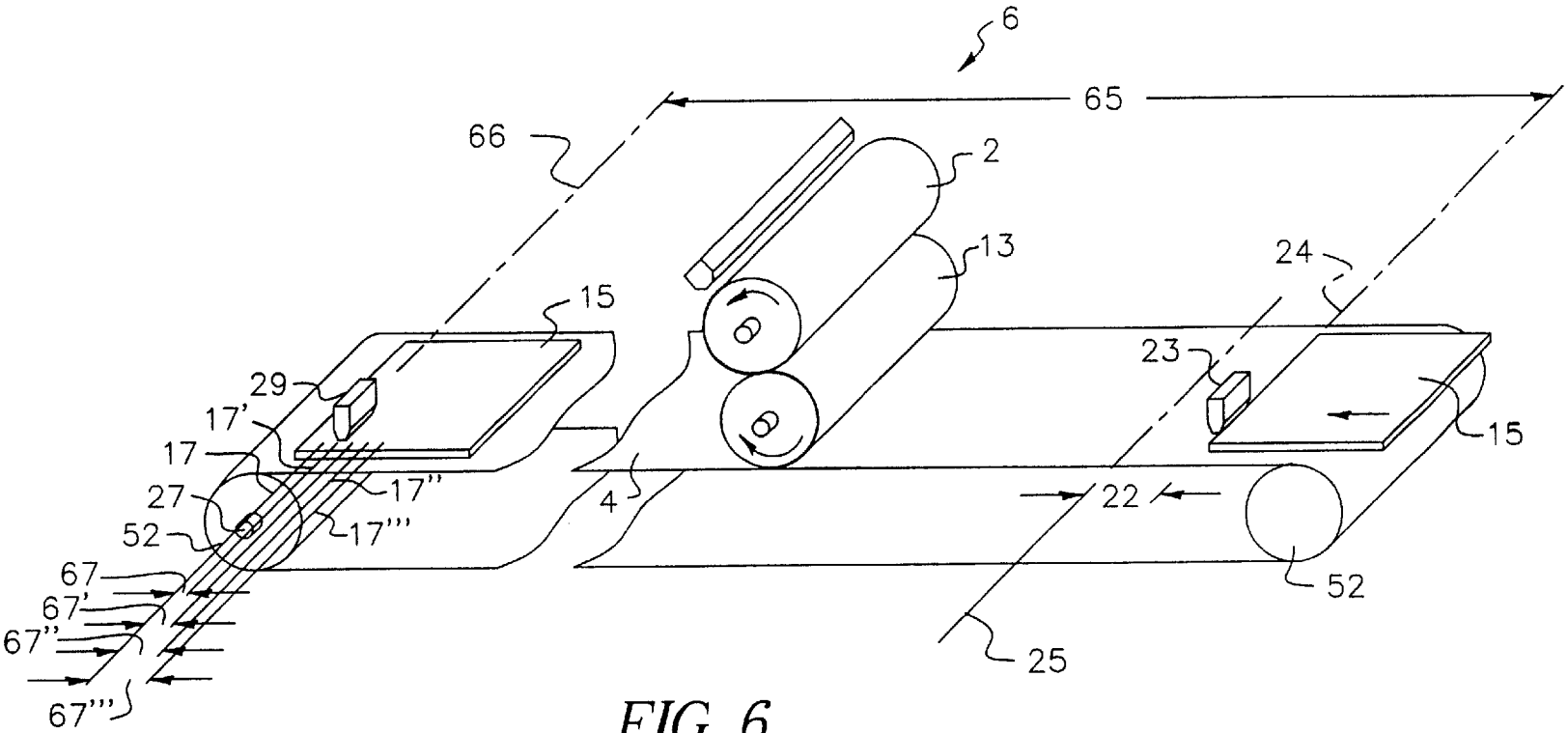
FIG. 6 shows a basic sketch for detecting register marks.

FIG. 6 shows a basic sketch for the detection of register marks. In each case a register mark 17, 17', 17", 17'" is printed by the color printing units 6, 6', 6", 6'" only one is shown symbolically. The position of such marks is measured by a sensor 29 for detecting register marks 17, 17', 17", 17'". For this purpose, in the register control system, a reference line 66 is defined and is allocated to a substrate 15 on the carrier 4. When this reference line 66 with the substrate 15 reaches a specific position in front of the register sensor 29, the latter is activated, in order to measure the distances of the register marks 17, 17', 17", 17'" in relation to this reference line 66. In this case, the respective distance 65 of the reference line 66 from the detection point 23 for the leading edge 24 of a printing substrate 15, and the determined distances of the register marks 17, 17', 17", 17'" from this reference line 66 can be measured as distances, for example. However, it is preferably proposed to allocate them to angular positions of the drive roller 52 of the carrier 4, these angular positions being measured by a sensor 27 designed as an angular position transmitter. The data pass in the manner illustrated above to devices 40, 40', . . . ; 41, 41', . . . for determining corrections for the image production 11, 11', . . . .

Figure 7:
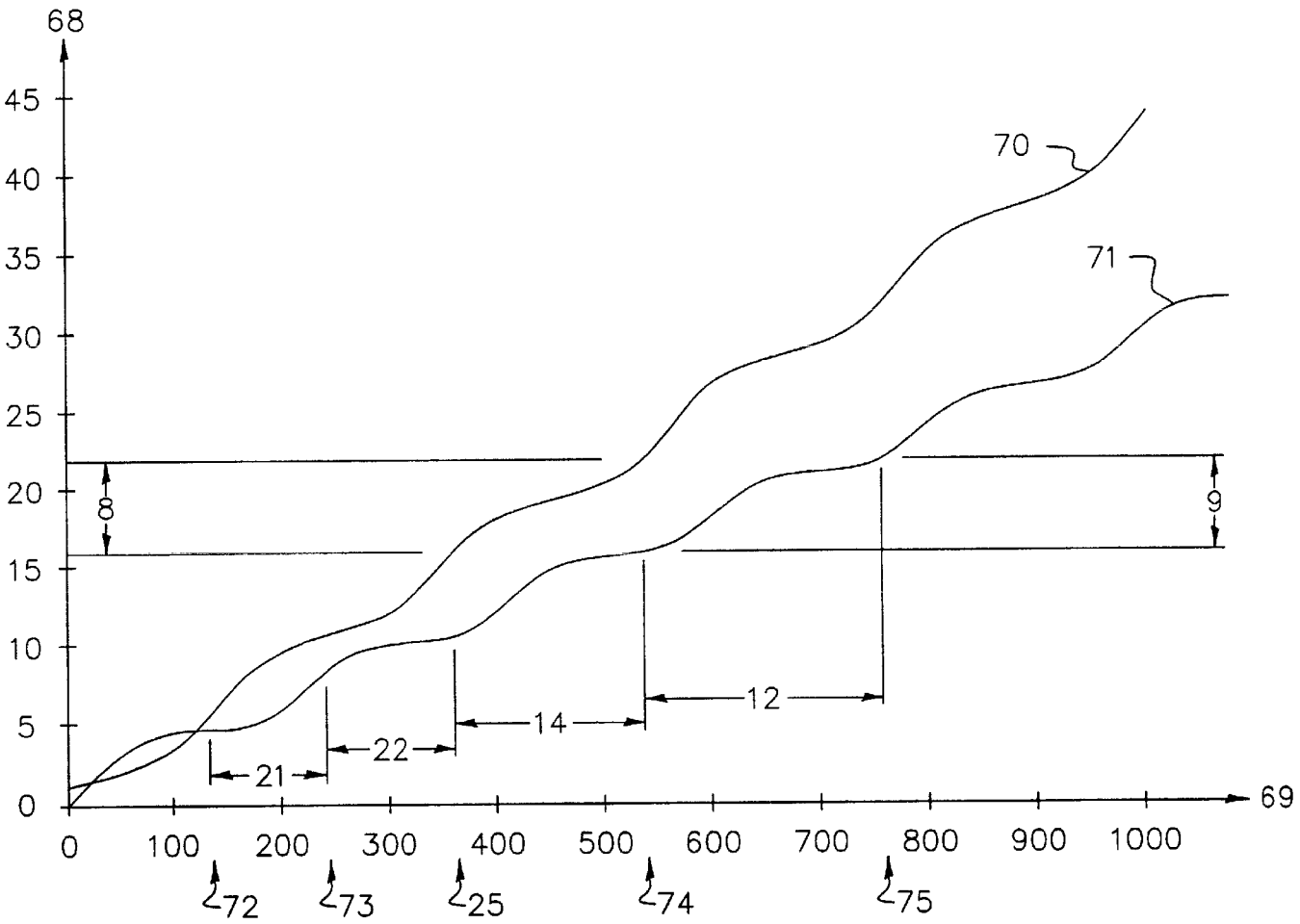
FIG. 7 shows an example of a time-independent allocation of positions.

FIG. 7 shows an example of time-independent position allocation. In the illustration, the angular positions 68 of the image cylinders and of the image transfer cylinders are plotted against the positions 69 of the carrier 4 for printing substrates. However, only the angular position 70 of one image cylinder 2 and the angular position 71 of one image transfer cylinder 13 have been shown. The angular positions of the further image cylinders 2' and so on would have to be shown by curves which are shifted with respect to the curves 70 and 71. For clarity, this has been dispensed with. The illustration shows that an angular position of an image cylinder 2 and an angular position of an image transfer cylinder 13 belong to each position 69 of the carrier 4 for printing substrates 15. In this way, a time-independent allocation of positions is therefore carried out, in order to start specific operations in the correct positions.

The first preparation for a print is started in the position 72; this is the position for the detection of a printing substrate 15 by a sensor 44, which registers the action of feeding the printing substrate 15 to the multicolor printing machine 1. From this time, the calculation of the image productions 11, 11', . . . of the color separations 7, 7', . . . takes place, the relative allocations being calculated. In a position 73, the printing substrate 15 is detected by the sensor 23 and, therefore, its exact position on the carrier 4 is determined, as a result of which the exact allocation of the image productions 11, 11', . . . of the color separations 7, 7', . . . to the carrier 4 is possible. Between the position 72 and the position 73, the printing substrate covers the distance 21. With the detection of the printing substrate in the position 73, the distance or the angular position of the drive roller 52 is calculated in order to determine the position 25. This is the position of the carrier 4 at which the beginning of an image production 11 of a color separation 7 on the image cylinder 2 begins. After a distance 14 of the carrier 4, in the position 74, the beginning of the transfer of the color separation 7 from the image cylinder 2 to the image transfer cylinder 13 is carried out. After a further distance 12 of the carrier 4, the latter reaches the position 75 for the beginning of the transfer of the color separation 7 from the image transfer cylinder 13 to a substrate 15. In this case, the distances 14 and 12 of the carrier 4 are allocated to angular positions 8 of the image cylinder and angular positions 9 of the image transfer cylinder 13. The important factor is that the image production and thus the transfers of the color separations 7, 7', . . . are determined by these position allocations. In a way corresponding to the start 10 of the image of the color separation 7, the position allocations of the defined areas 10, 10', 10", . . . , 10$^n$ of all the color separations 7, 7', . . . are carried out.

However, the position allocations according to the invention do not mean that the distance length on the cylinders 2, 2', . . . ; 13, 13', . . . and the carrier 4 are equal, since overdriving occurs during the transfers of the color separations 7, 7', . . , for example from an image cylinder 2, 2', . . . to an image transfer cylinder 13, 13' . . . . This means that, as a result of the rubberlike property of the cylinder cover, no rolling over an identical distance takes place, but that the surface of the image transfer cylinders 13, 13', . . . is moved faster than would be the case were ideal cylinders to roll on one another. In addition, slip is produced, and likewise leads to no exact distance-length allocation being possible.

Phenomena of this type, which effect differences in the distance length, have to be taken into account during the allocation of positions, for example of angular positions 68 of the image cylinders 2, 2', . . . and of the image transfer cylinders 13, 13', . . . to positions 69 of the carrier 4, in order to determine the correct position 25 for the image productions 11, 11', . . . . If distances are put in relationships to one another, corrections for differences in distance, for example as a result of overdrive, slippage and similar phenomena, must also be included in the calculations.

It is expedient if the basic allocations are input as machine-specific parameters, which are then continuously checked and corrected before and during printing. By these corrections, over-drive, slippage and similar changes can be compensated for, these occurring as a result of different toner application or a large number of further causes. If these values vary over the width of the printing substrate, then it is expedient if these allocations are based on the averages.

The exemplary embodiment illustrated serves merely to explain the invention and, at the same time, constitutes an advantageous embodiment. The method described at the beginning, and the apparatus of the invention, can, of course, be implemented in a machine in a large number of ways. Not only are alternatives relating to the measurement of position, which have been mentioned, possible, but also the actual acquisition and processing of the data can of course be designed in a different way.

The invention has been described in detail with particular reference to certain preferred embodiment thereof, but it will be understood that variations and modifications can be effected within the spirit and scope of the invention.

| Parts List | |
|---|---|
| 1 | Multicolor printing machine |
| 2, 2', . . . | Image cylinders |
| 3, 3', . . . | Equipment for producing images, for example, electrostatic latent images |
| 4 | Carrier for printing substrates |
| 5, 5', 5", 5"' | Image transfer points |
| 6, 6', 6", 6"' | Color printing units |
| 7, 7', . . . | Color separations |
| 8, 8', . . . | Positions (e.g., as distances or angular positions) of defined areas of the color separations on the image cylinders |
| 9, 9', . . . | Positions (e.g., as distances or angular positions) of defined areas of the color separations on the image transfer cylinders |
| 10, 10', 10", . . . , 10$^n$ | Defined areas of the color separations |
| 10 | Image starts/beginning of the image setting |
| 10', 10", . . . , 10$^n$ | Areas of the color separations into which the image area is subdivided |
| 11, 11', . . . | Image productions |
| 12, 12', . . . | Positions (e.g., as distances or angular positions of the drive roller) on the carrier corresponding to the positions 9, 9', . . . |
| 13, 13', . . . | Image transfer cylinders |
| 14, 14', . . . | Positions (e.g., as distances or angular positions of the drive roller) on the carrier corresponding to the positions 8, 8', . . . |
| 15 | Printing substrates |
| 16, 16', . . . | Direction of rotation of the image cylinders |
| 17, 17', 17", 17"' | Register marks (various color printing units) |
| 18 | Regularly spaced elements of the register marks |
| 19 | Distances between the regularly spaced elements |

-continued

| Parts List | |
|---|---|
| 20 | Impression cylinders |
| 21 | Distance covered by the printing substrate during which the positions 12, 12', . . . , 14, 14', . . . , 22, 22', . . . are calculated |
| 22, 22', . . . | Positions (distances or angular positions of the drive roller) of the carrier from a detection point for a substrate as far as the beginning of the image setting operation |
| 23 | Sensor: detection point for printing substrates (leading edge) |
| 24 | Leading edge of a printing substrate |
| 25, 25', . . . | Positions of the carrier at which the beginning of an image setting operation or the image setting with one of the areas of the color separations takes place on an image cylinder |
| 26, 26', . . . | Sensors for detecting the positions of the image cylinders (e.g., angular position transmitters) |
| 27 | Sensors for detecting the carrier (e.g., angular position transmitters) |
| 28, 28', . . . | Sensors for measuring the positions of the image transfer cylinders (e.g., angular position transmitters |
| 29 | Sensor for detecting the register marks |
| 30, 30', . . . | Setting devices for the image starts |
| 31, 31', . . . | Setting devices for defined areas of the color separations |
| 32 | Sensor for detecting distance markings on the carrier |
| 33 | Arrow: transport direction of the printing substrates |
| 34, 34', . . . | Machine-specific nominal values of the positions of the image starts |
| 35, 35', . . . | Machine-specific nominal values of the positions of the areas of the color separations into which the image are is subdivided |
| 36, 36', . . . | Correction values for the positions on the image cylinders |
| 37, 37', . . . | Correction values for the positions on the image transfer cylinders |
| 38, 38', . . . | Correction values as values from experience |
| 39, 39', . . . | File |
| 40, 40', . . . | Devices for determining the corrections for the image starts |
| 41, 41', . . . | Devices for determining the corrections for areas of the color separations into which the image area is subdivided |
| 42, 42', . . . | Corrections for the image starts |
| 43, 43', . . . | Corrections for areas of the color separations into which the image area is subdivided |
| 44 | Sensor for detecting a printing substrate, which is fed to the printing machine |
| 45 | Transport belt for feeding a printing substrate to the printing machine |
| 46, 46', . . . | Devices for calculating the positions 25, 25', . . . , e.g., in the form of distances 22, 22', . . . or corresponding angular positions of the drive roller of the carrier |
| 47, 47', . . . | Devices for allocating the areas of the color separations into which the image area is subdivided to the positions of the image cylinders |
| 48, 48', . . . | Starting signals for the image starts |
| 49, 49', . . . | Starting signals for the areas of the color separations into which the image area is subdivided |
| 50, 50', . . . | Connections between the sensors 26, 26', . . . and the devices 47, 47', . . . |
| 51, 51', . . . | Connections between the devices 46. 46', . . . and 47, 47', . . . |
| 52 | Drive roller of the carrier belt (carrier 4) |
| 52' | Guide roller of the carrier belt |
| 53, 53', . . . | Image transfer points from image cylinder to image transfer cylinder |
| 54 | Desired value (straight line) |
| 55 | Deviations from the desired value |
| 56 | Distance of the measured points along the transport direction |
| 57 | Measured points in the case of time control |
| 58 | Measured points in the case of position control |
| 59 | Direction of rotation of the impression cylinders |
| 60, 60', . . . | Directions of rotation of the image transfer cylinders |
| 61, 61', . . . | Devices for removing the set image from the image cylinders |
| 62, 62', . . . | Devices for removing the set image from the image transfer cylinder |
| 63 | Device for removing register marks printed onto the carrier |
| 64 | Distance between two color printing units |
| 65 | Instantaneous distance between the reference line 66 and the detection point 23 |

-continued

| Parts List | |
|---|---|
| 66 | Reference line |
| 67, 67', 67", 67 | Distances between register marks 17, 17', 17", 17"', each consisting of an element 18 and belonging to the color separations 7, 7', . . . from the reference line 66 |
| 68 | Angular positions of the image cylinders and of the image transfer cylinders |
| 69 | Positions of the carrier for printing substrates |
| 70 | Angular positions of an image cylinder |
| 71 | Angular positions of an image transfer cylinder |
| 72 | Position at which a printing substrate is detected by the sensor 44 |
| 73 | Position at which a printing substrate is detected by the sensor 23 |
| 74 | Position for the beginning of the transfer of the color separation 7 from the image cylinder 2 to the image transfer cylinder 13 |
| 75 | Position for the beginning of the transfer of the color separation 7 from the image transfer cylinder 2 to a printing substrate 15 |

What is claimed is:

1. A method for setting register on a multicolor printing machine (1) having color printing units (6, 6', 6", 6'") assigned to various printing inks and having image cylinders (2, 2', . . . ), equipment (3, 3', . . . ) for producing images, in particular electrostatic latent images, on the image cylinders (2, 2', . . . ), a carrier (4) for printing substrates (15) and image transfer points (5, 5', 5", 5'") for the transfer of the color separations (7, 7', . . . ) from the color printing units (6, 6', 6", 6") to the printing substrates (15), comprising: during production of a print from an electrostatic latent image, an allocation of the image productions (11, 11', . . . ) on the image cylinders (2, 2', . . . ) to the printing substrates (15) being carried out in order to achieve coincidence of register of the color separations (7, 7', . . . ) in the print, wherein a time-independent allocation of the positions of the image productions (11, 11', . . . ) on the image cylinders (2, 2', . . . ) to the printing substrates (15) is carried out for at least one defined area (10, 10', 10", . . . , 10$^{n}$) of all the color separations (7, 7', . . . ).

2. The method as claimed in claim 1, wherein, for the color separations (7, 7', . . ), in each case the at least one defined area (10, 10', 10", . . . , 10$^{n}$) on the image cylinders (2, 2', . . . ) is generated in relation to predefined positions (25, 25', . . . ) of the carrier (4).

3. The method as claimed in claim 1, wherein at least one defined area (10, 10', 10", . . . , 10$^{n}$) of the color separation (7) of a reference color printing unit (6) is allocated at least one defined area (10, 10', 10", . . . , 10$^{n}$) in each case of the color separations (7', . . . ) of the other color printing units (6', 6", 6'"), and wherein an allocation is then made to a position (25, 25', . . . ) of the carrier (4).

4. The method as claimed in claim 3, wherein, for the allocations of the positions (25, 25', . . . ) of the carrier (4), the angular positions of the drive roller (52) of the carrier (4) are used.

5. The method as claimed in claim 3, wherein for the allocations of the positions of the image cylinders (2, 2', . . . ) their angular positions (8, 8', . . . ) are used.

6. The method as claimed in claim 4, wherein for the allocations of the positions (25, 25', . . . ) of the carrier (4), the distances (12, 12', . . . ; 14, 14', . . . ; 22, 22', . . . ) covered by the surface of the carrier (4) are used.

7. The method as claimed in claim 6, wherein for the allocations of the positions of the image cylinders (2, 2', . . . ), the distances (8, 8', . . . ) covered by the surfaces of the image cylinders (2, 2', . . . ) are used.

8. The method as claimed in claim 7, wherein the positions (9, 9', . . . ) of image transfer cylinders (13, 13', . . . ) are also included in the allocations of position.

9. The method as claimed in claim 8, wherein for the allocations of the position of the image transfer cylinder (13, 13', . . . ), their angular positions (9, 9', . . . ) are used.

10. The method as claimed in claim 8, wherein for the allocations of the positions of the image transfer cylinders (13, 13', . . . ), the distances (9, 9', . . . ) covered by the surfaces of the image transfer cylinders (13, 13', . . . ) are used.

11. The method as claimed in claim 10, wherein the defined areas of the color separations (7, 7', . . . ), which are allocated to one another, are the image starts (10).

12. The method as claimed in claim 11, wherein the defined areas (10', 10", . . . , 10$^{n}$ ) that are allocated to one another are areas (10' 10", . . . , 10$^{n}$) of the color separations (7, 7', . . . ) into which the image areas are subdivided.

13. The method as claimed in claim 12, wherein the areas (10, 10', 10", . . . 10$^{n}$) are lines of image points of the color separations (7, 7', . . . ).

14. The method as claimed in claim 12, wherein the areas (10, 10', 10", . . . , 10$^{n}$) are in each case a number of lines of image points of the color separations (7, 7', . . . ).

15. The method as claimed in claim 14, wherein the number of lines of image points results from the allocation to defined angular intervals of the image cylinders (2, 2', . . . ).

16. The method as claimed in claim 15, wherein the lateral position of the areas (10, 10', 10", . . , 10$^{o}$) is also determined and set.

17. The method as claimed in claim 16, wherein faults relating to the lateral extent of the areas (10, 10', 10", . . . , 10$^{n}$) are also determined and corrected.

18. The method as claimed in claim 17, wherein the positions (8, 8', . . . ; 9, 9', . . . ; 12, 12', . . . ; 14, 14', . . . ; 25, 25', . . . ) are determined before a print job is processed and are coordinated with one another.

19. The method as claimed in claim 18, wherein the positions (8, 8', . . . ; 9, 9', . . . ; 12, 12', . . . ; 14, 14', . . . ; 22, 22', . . . ; 25, 25', . . . ) are registered continuously during the processing of a print job and are coordinated with one another.

20. The method as claimed in claim 19, wherein the positions (8, 8', . . . ; 9, 9', . . . ; 12, 12', . . . ; 14, 14', . . . ; 22, 22', . . . ; 25, 25', . . . ) are determined by register marks (17, 17').

21. The method as claimed in claim 20, wherein the register marks (17, 17', 17", 17'") have elements (18) that are arranged in the transport direction (14) and spaced apart in a predefined way.

22. The method as claimed in claim 21, wherein distances (19) between the regularly spaced elements (18) are registered.

23. The method as claimed in claim 22, wherein the register marks (17, 17', 17", 17'") are printed on to the carrier (4) and removed again after the determination of the position.

24. The method as claimed in claim 23, wherein the register marks (17, 17', 17", 17'") are printed in the space on the carrier (4) not covered by printing substrates (15).

25. The method as claimed in claim 24, wherein the register marks (17, 17', 17", 17'") are printed on paper.

26. The method as claimed in claim 25, wherein by an analysis of the determined positions 8, 8', . . . ; 9, 9', . . . ; 12, 12', . . . ; 14, 14', . . . ; 22, 22', . . ; 25, 25', . . . ), the deviations of the actual values from the desired values for the image starts (10) are separated from the deviations from the actual values for the other areas (10', 10", . . , $10^n$) into which the image areas are subdivided.

27. The method as claimed in claim 26, wherein, following the determination of the positions 8, 8', . . . ; 9, 9', . . . ; 12, 12', . . . ; 14, 14', . . . ; 25, 25' . . . ) for the image starts (10) on the individual image cylinders (2, 2', . . . ), these positions are determined for the image production of the other defined areas (10, 10', . . . , $10^n$) on the individual image cylinders (2, 2', . . . ) in a manner linked to the first image production, and are used in this sequence for controlling or regulating the image productions (11, 11', . . . ).

28. The method as claimed in claim 27, wherein in the values registered, fluctuations that occur in the very short term are eliminated to avoid control instability for the evaluation.

29. Method as claimed in claim 28, wherein fluctuations in the determined position values which, with regard to their order of magnitude and repetition, can be allocated to a repeatable position of a cylinder (2, 2', . . . ; 13, 13', . . . ), are separated from longer-term fluctuations.

30. The method as claimed in claim 29, wherein the fluctuations in the determined position values (8, 8', . . . ; 9, 9', . . . ; 12, 12', . . . ; 14, 14', . . . ; 25, 25', . . . ) which, with regard to their order of magnitude and repetition, can be allocated to a repeatable position of an image cylinder (2, 2', . . . ), are entered into at least one calibration table for this image cylinder (2, 2', . . . ), and used for the fault-compensating control of the positions of the image production (11, 11', . . . ).

31. The method as claimed in claim 30, wherein calibration tables are drawn up for the image starts (10) of the color separations (7, 7', . . . ).

32. The method as claimed in claim 30, wherein calibration tables are drawn up for the other defined areas (10', 10", . . . , $10^n$) of the color separations (7, 7', . . . ).

33. The method as claimed in claim 32, wherein, for at least one further element (13, 13' . . . ; 4; 20; 52, 52') that carries an image or substrate, deviations of the positions (8, 8', . . . ; 9, 9', . . . ; 12, 12', . . . ; 14, 14', . . . ; 25, 25', . . . ) from the desired values which can be allocated to repeatable positions in a movement cycle are also registered and included in the calculation of the positions of the image production points (11, 11', . . . ).

34. The method as claimed in claim 33, wherein for this at least one element (13, 13', . . . ; 4; 20; 52, 52'), at least one calibration table is also drawn up, and all the calibration tables are included in the calculation of the positions of the image production points (11, 11' . . . ).

35. The method as claimed in claim 34, wherein the longer-term fluctuations in the determined position values are taken into account by renewing the calibration tables.

36. The method as claimed in claim 35, wherein errors in the determined position values which are longer term and cannot by their repetition be allocated to a repeatable position of an element (2, 2', . . . ; 13, 13', . . . ; 4; 20; 52, 52') that carries an image or substrate are taken into account by including the influencing variables which cause them in the correction for the register control.

37. The method as claimed in claim 36, wherein the influencing variables are included in the correction on the basis of stored values from experience.

38. The method as claimed in claim 37, wherein the inclusion of the influencing variables is activated by a manual input.

39. The method as claimed in claim 37, wherein the inclusion of the influencing variables is activated by measuring the same.

40. The method as claimed in claim 39, wherein the influencing variables are measured in terms of their effects on the register, and a correction to the image productions (11, 11', . . . ) is carried out in accordance with these deviations.

41. The method as claimed in claim 40, wherein the measurement of the temperature at chosen points on the printing machine (1) is the basis for a correction.

42. The method as claimed in claim 40, wherein the measurement of stresses on chosen machine parts of the printing machine (1) is the basis for a correction.

43. The method as claimed in claim 40, wherein values from experience for various paper grades are available for a correction in the event of a paper grade change.

44. The method as claimed in claim 40, wherein values from experience for different toner profiles are available for a correction.

45. The method as claimed in claim 44, wherein a displacement of a substrate (15) on the carrier (4) is registered, and the positions of the image productions (11, 11', . . . )are corrected in order to compensate for this displacement.

46. The method as claimed in claim 45, wherein values from experience for various image widths are available for a correction.

47. The method as claimed in claim 46, wherein values from experience for various paper widths are available for the correction.

48. The method as claimed in claim 47, wherein values from experience for changes in the substrate dimensions after a substrate (15) has been printed on one side are taken into account in order that the image size of the verso print corresponds to the image size of the recto print.

49. The method as claimed in claim 48, wherein, in the case of the values from experience, the retroactive influence of a state preceding a change is taken into account.

50. The method as claimed in claim 49, wherein fluctuations in the position values which, with regard to their repetition, cannot be allocated to the angular position of an image cylinder (2, 2', . . . ), but regularly occur repeatedly, are entered into separate calibration tables and used for the fault compensating control of the equipment (3, 3', . . . ) for producing images on the respective image cylinders (2, 2', . . . ).

51. The method as claimed in claim 50, wherein fluctuations in the position values which, with regard to their repetition, can be allocated to a position of the carrier (4) for the printing substrates (15), are corrected in accordance with the positions of the carrier (4), this correction being added to the corrections of the position values which can be allocated to the position of the image cylinders (2, 2', . . . ).

52. The method as claimed in claim 51, wherein fluctuations in the position values are avoided by ruling out their causes.

53. The method as claimed in claim 52, wherein the circumference of the drive roller (52) of the carrier (4) is dimensioned, in relation to the distance (64) of the image transfer points (5, 5', 5", 5'") of the color printing units (6, 6', 6", 6'"), in such a way that the allocation of the angular positions of the drive roller (52) to the image cylinders (2, 2', . . . ) repeats.

54. The method as claimed in claim 51, wherein within a tolerable bandwidth of registered position values, the correction is set to an average range.

55. The method as claimed in claim 54, wherein in the event of different position values transverse to the transport direction (33), an average value is set.

56. The method as claimed in claim 55, wherein in order to calculate the average range, the determined deviations are weighted.

57. The method as claimed in claim 56, wherein quadratic weighting is carried out.

58. The method as claimed in claim 56, wherein the values from the color printing units (6', 6", 6'"), which lie in the average range, are brought into alignment with the value from a reference printing unit (6), which lies in the average range.

59. The method as claimed in claim 58, wherein the arrival of a printing substrate (15) is detected, and wherein the positions (25, 25') for the respective beginning of setting the image on the image cylinders (2, 2', . . . ) are determined as the positions (22, 22', . . . ) of the carrier (4) starting from the detection point for printing substrates (15).

60. Apparatus for setting register on a multicolor printing machine (1) having color printing units (6, 6', 6", 6'") allocated to various printing inks and having image cylinders (2, 2', . . . ), equipment (3, 3', . . . ) for generating images, in particular electrostatic latent images, on the image cylinders (2, 2', . . . ), a carrier (4) for printing substrates (15) and image transfer points (5, 5', 5", 5'") for the transfer of the color separations (7, 7', . . . ) from the color printing units (6, 6', 6", 6'") to printing substrates (15), sensors (23; 26, 26', . . . ; 27; 28, 28', . . . ; 29) for measuring position and at least one setting device (30, 30', . . . ; 31, 31', . . . ) for allocating the positions of the image production points (11, 11', . . . ) on the image cylinders (2, 2', . . . ) to the printing substrates (50) in order to achieve coincidence of register of the color separations (7, 7', . . . ) in the print, wherein the sensors (23; 26, 26', . . . ; 27; 28, 28', . . . ; 29) are provided to detect the positions of elements (2, 2', . . ; 4; 13, 13', . . . ) that carry images and substrates, and wherein at least one setting device (30, 30', . . . ; 31, 31', . . . ) is such that it allocates the positions of the image productions (11, 11', . . . ) on the image cylinder (2, 2', . . . ) to the printing substrates (15) with regard to at least one defined area (10, 10', 10", . . . , 10$^{n}$) of the color separations (7, 7', . . . ) in a manner independent of time.

61. The apparatus as claimed in claim 60, wherein the at least one setting device (30, 30', . . . ; 31, 31', . . . ) is such that it initiates the production (11, 11' . . . ) of at least one defined area (10, 10', 10", . . . , 10$^{n}$) of all the color separations (7, 7', . . . ) on the respective image cylinders (2, 2', . . . ) in relation to predefined positions (25, 25', . . . ) of the carrier (4).

62. The apparatus as claimed in claim 61, wherein at least one sensor (26, 26', . . . ; 27; 28, 28', . . . ) is an angular position transmitter.

63. The apparatus as claimed in claim 62, wherein at least one setting device (30, 30', . . . ; 31, 31', . . . ) is to allocate angular positions.

64. The apparatus as claimed in claim 63, wherein at least one sensor is provided to detect a circularity error, as well as at least one setting device (30, 30', . . . ; 31, 31', . . . ) which determines positions (8, 8', . . . ; 9, 9', . . . ; 12, 12', . . . ; 14, 14', . . . ; 22, 22', . . . ) from angular positions and circularity errors.

65. The apparatus as claimed in claim 64, wherein at least one sensor (26, 26', . . . ; 27; 32) is to measure distances (8, 8', . . . ; 9, 9', . . . ; 12, 12', . . . ; 14, 14', . . . ; 22, 22', . . . ).

66. The apparatus as claimed in claim 65, wherein sensors (26, 26', . . . ; 27; 28, 28', . . . ; 32) are to detect distance markings, and the latter are applied to the corresponding surfaces.

67. The apparatus as claimed in claim 66, wherein at least one setting device (30, 30', . . . ; 31, 31', . . . ) is to allocate distances (8, 8', . . . ; 9, 9', . . . ; 12, 12', . . . ; 14, 14', . . . , ; 22, 22', . . . ).

68. The apparatus as claimed in claim 67, wherein in each case at least one sensor (28, 28', . . . ) is provided to detect the positions of the image transfer cylinders (13, 13', . . . ) and these are transmitted to the at least one setting device (30, 30', . . . ; 31, 31', . . . ) in order to calculate the image productions (11, 11', . . . ).

69. The apparatus as claimed in claim 66, wherein at least one setting device (30, 30', . . . ) is such that it predefines the positions (25, 25', . . . ) of the carrier (4) at which the beginning (10) of the image setting on the image cylinders (2, 2', . . . ) takes place.

70. The apparatus as claimed in claim 69, wherein at least one setting device (31, 31', . . . ) is such that it predefines the positions (25, 25', . . . ) of the carrier (4) at which the setting of images on the image cylinder (2, 2') with the areas (10', 10", . . . , 10$^{n}$) into which the image area is subdivided is carried out.

71. The apparatus as claimed in claim 70, wherein at least one sensor (29) is provided to detect register marks (17, 17', 17", 17'").

72. The apparatus as claimed in claim 71, wherein the at least one sensor (29) is measure distances (19) between elements (18) of the register marks (17, 17', 17", 17'") which are spaced apart in a predefined way.

73. The apparatus as claimed in claim 72, wherein the setting devices (30, 30', . . . ; 31, 31', . . . ) are provided with machine-specific nominal values (34, 34', . . . ; 35, 35', . . . ) of the positions (8, 8', . . . ; 9, 9', . . . ; 12, 12', . . . ; 14, 14', . . . ; 22, 22', . . . ; 25, 25', . . . ).

74. The apparatus as claimed in claim 72, wherein the setting devices (30, 30', . . . ; 31, 31', . . . ) are such that, before the start of printing, they take into account correction values (36, 36', . . . ) for the positions (8, 8', . . . ) of the image productions (11, 11', . . . ) on the image cylinders.

75. The apparatus as claimed in claim 72, wherein the setting devices (30, 30', . . . ; 31, 31', . . . ) are such that, before the start of printing, they take into account correction values (37, 37', . . . ) for the positions (9, 9', . . . ) on the image transfer cylinders (13, 13', . . .).

76. The apparatus as claimed in claim 72, wherein the setting devices (30, 30', . . . ; 31, 31', . . . ) are such that, after the start of printing, they take into account correction values (36, 36', . . . ; 37, 37', . . . ; 38, 38', . . . ) for the positions (8, 8', . . . ; 9, 9', . . . ; 12, 12', . . . ; 14, 14', . . . ; 22, 22', . . . 25, 25', . . .).

77. The apparatus as claimed in claim 72, wherein the setting devices (30, 30', . . . ; 31, 31', . . . ) are such that, before the start of printing, they take into account correction values (38, 38', . . . ) for the determination of the positions 8, 8', . . . ; 9, 9', . . . ; 12, 12', . . . ; 14, 14', . . . ; 22, 22', . . . ; 25, 25', . . . ) which can be allocated to influencing variables which can be registered, and are available as at least one selectable file (39, 39', . . . ) with values from experience.

78. The apparatus as claimed in claim 77, wherein the choice of at least one file (39, 39', . . . ) is made via an input device.

79. The apparatus as claimed in claim 77, wherein the choice of at least one file (39, 39', . . . ) by at least one setting device (30, 30', . . . ; 31, 31', . . . ) is made on the basis of at least one measurement of at least one influencing variable.

80. The apparatus as claimed in claim 79, wherein the sensors (23; 26, 26', . . . ; 27; 28, 28', . . . ; 29; 32) and the setting devices (30, 30', . . . ; 31, 31', . . . ) are such that the effects of the influencing variables on the register are measured and a correction to the image setting is made in accordance with these deviations.

81. The apparatus as claimed in claim 80, wherein the influencing variable is at least one temperature in the printing machine (1).

82. The apparatus as claimed in claim 81, wherein at least one temperature sensor is arranged in the printing machine (1).

83. The apparatus as claimed in claim 82, wherein the influencing variable is at least one mechanical stress in the printing machine (1).

84. The apparatus as claimed in claim 83, wherein at least one stress sensor is arranged in the printing machine (1).

85. The apparatus as claimed in claim 84, wherein the influencing variable is the paper grade.

86. The apparatus as claimed in claim 85, wherein the influencing variable is the toner profile.

87. The apparatus as claimed in claim 86, wherein it is equipped with a device for measuring a toner profile.

88. The apparatus as claimed in claim 87, wherein a sensor is provided for detecting a displacement of a substrate (15) on the carrier (4), and the setting devices (30, 30', . . . ; 31, 31', . . . ) are such that the positions of the image productions (11, 11', . . . ) can be corrected in order to compensate for this displacement.

89. The apparatus as claimed in claim 88, wherein the circumference of the drive roller (52) of the carrier (4) can be inserted as a whole number into the distance (64) between the image transfer points (5, 5', 5", 5'") of the color printing units (6, 6', 6", 6'").

90. The apparatus as claimed in claim 89, wherein at least one device (40, 40', . . . ; 41, 41', . . . ), on the basis of measuring the positions (8, 8', . . . ; 9, 9', . . . ; 12, 12', . . . ; 14, 14', . . . ; 22, 22', . . . ; 25, 25', . . . ) during printing, determines necessary corrections (42, 42', . . . ; 43, 43', . . . ) to the positions (8, 8', . . . ; 9, 9', . . . ; 12, 12', . . . ; 14, 14', . . . ; 22, 22', . . . ; 25, 25', . . . ), and transmit these to the setting devices (30, 30', . . . ; 31, 31', . . . ) for implementation.

91. The apparatus as claimed in claim 90, wherein at least one device (40, 40', . . . ) for determining the corrections (42, 42', . . . ) for the image starts (10) is connected to the sensor (27) for measuring the positions (12, 12', . . . ; 14, 14', . . . ; 22, 22', . . . ; 25, 25', . . . ) of the carrier (4) and to the sensor (29) for detecting the register marks (17, 17', 17", 17'").

92. The apparatus as claimed in claim 90, wherein at least one device (41, 41', . . . ) for determining the corrections (43, 43', . . . ) for areas (10', 10", . . . , 10$^n$) of the color separations (7, 7', . . . ) into which the image areas are subdivided is connected to the sensor (27 and/or 32) for measuring the positions (12, 12', . . . ; 14, 14', . . . ) of the carrier (4) and to the sensor (29) for detecting the register marks (17, 17', 17", 17'").

93. The apparatus as claimed in claim 92, wherein devices (46, 46', . . . ) for the output of starting signals (48, 48', . . . ) for the image starts (10) at the same time give starting signals to devices (47, 47', . . . ) for allocating the areas (10', 10", . . . , 10$^n$) into which the image area is subdivided, these devices (47, 47', . . . ) being connected to sensors (26, 26', . . . ) for measuring the positions of the image cylinders (2, 2', . . . ), and allocating to these positions the areas (10', 10", . . . 10$^n$) into which the image area is subdivided.

94. The apparatus as claimed in claim 93, wherein a sensor (44) for detecting a printing substrate (15) which is fed to the printing machine (1) is arranged on the distance of the printing substrates (15) to the printing machine (1) and is connected to the setting devices (30, 30', . . . ; 31, 31', . . . ), the calculation of the allocation of the positions of the image production points (11, 11', . . . ) to the printing substrate (15) being started when a printing substrate (15) is detected.

95. The apparatus as claimed in claim 94, wherein a sensor (23) for the precise detection of the leading edges (24) of printing substrates (15) is arranged on the carrier (4) and connected to a device (46, 46', . . . ) which calculates the distances or angular positions (22, 22', . . . ) which the printing substrate covers from the sensor (23) as far as the positions (25, 25', . . . ) of the beginning of the respective image setting, and initiates the beginning of the same in these positions.

96. A multicolor printing machine (1) having apparatus for register setting, the multicolor printing machine (1) being equipped with color printing units (6, 6', . . . ) allocated to various printing inks and having image cylinders (2, 2', . . . ), equipment (3, 3', . . . ) for the production of images, in particular of electrostatic latent images, on the image cylinders (2, 2', . . . ), a carrier (4) for printing substrates (15) and image transfer points (5, 5', 5", 5'") for the transfer of the color separations (7, 7', . . . ) from the color printing units (6, 6', 6", 6'") to printing substrates (15), sensors (23; 26, 26', . . . ; 27; 28, 28', . . . ; 29) for measuring position and at least one control and regulating device (30, 30', . . . ; 31, 31', . . . ) for allocating the positions of the image production points (11, 11', . . . ) on the image cylinders (2, 2', . . . ) to printing substrates (15) to achieve coincidence of register of the color separations (7, 7', . . . ) in the print, wherein the sensors (23; 26, 26', . . ; 27; 28, 28', . . . ; 29) are provided to measure the positions of elements (2, 2', . . ; 4, 13, 13', . . . ) that carry images and substrates, and wherein at least one setting device (30, 30', . . . ; 31, 31', . . . ) is such that it allocates the positions of the image productions (11, 11', . . . ) on the image cylinders (2, 2', . . . ) to the printing substrates (15) with regard to at least one defined area (10, 10', 10", . . . , 10$^n$) of the color separations (7, 7', . . . ) in a time-independent manner.

* * * * *